US010493331B2

(12) United States Patent
Kroloff et al.

(10) Patent No.: US 10,493,331 B2
(45) Date of Patent: Dec. 3, 2019

(54) GOLF CLUB HEADS AND METHODS TO MANUFACTURE GOLF CLUB HEADS

(71) Applicant: Parsons Xtreme Golf, LLC, Scottsdale, AZ (US)

(72) Inventors: Caleb S. Kroloff, Phoenix, AZ (US); Bradley D. Schweigert, Anthem, AZ (US); Michael R. Nicolette, Scottsdale, AZ (US)

(73) Assignee: Parsons Xtreme Golf, LLC, Scottsdale, AZ (US)

( * ) Notice: Subject to any disclaimer, the term of this patent is extended or adjusted under 35 U.S.C. 154(b) by 0 days.

(21) Appl. No.: 16/275,883

(22) Filed: Feb. 14, 2019

(65) Prior Publication Data

US 2019/0175995 A1 Jun. 13, 2019

Related U.S. Application Data

(63) Continuation of application No. 16/006,055, filed on Jun. 12, 2018.

(Continued)

(51) Int. Cl.
*A63B 53/02* (2015.01)
*A63B 53/04* (2015.01)

(Continued)

(52) U.S. Cl.
CPC ..... *A63B 53/02* (2013.01); *A63B 1/00* (2013.01); *A63B 53/04* (2013.01);

(Continued)

(58) Field of Classification Search
CPC ..... A63B 53/0487; A63B 2053/0491; A63B 2053/0433; A63B 60/54;

(Continued)

(56) References Cited

U.S. PATENT DOCUMENTS

| | | | |
|---|---|---|---|
| 922,444 | A | 5/1909 | Youds |
| RE19,178 | E | 5/1934 | Spiker |

(Continued)

FOREIGN PATENT DOCUMENTS

| | | |
|---|---|---|
| JP | 2005160691 | 6/2005 |
| WO | 2006087846 | 8/2006 |

OTHER PUBLICATIONS

U.S. Appl. No. 29/523,587, Schweigert, "Golf Club Head," filed Apr. 10, 2015.

(Continued)

*Primary Examiner* — Michael D Dennis

(57) ABSTRACT

Examples of golf club heads and methods to manufacture golf club heads are generally described herein. In one example, a body portion of a golf club head may include a cavity having an opening and an internal structure defined by a wall portion and a base portion. A hosel portion may include an insert portion and a neck portion extending therefrom. The hosel portion may be attached to the body portion by an interference fit between the neck portion and the opening of the cavity. The insert portion may be received inside the cavity and may be spaced apart from the internal structure of the cavity. A space between the insert portion and the internal structure of the cavity may be partially or entirely filled with an adhesive to hold the hosel portion in place. Other examples may be described and claimed.

20 Claims, 18 Drawing Sheets

Related U.S. Application Data

(60) Provisional application No. 62/518,715, filed on Jun. 13, 2017, provisional application No. 62/533,481, filed on Jul. 17, 2017, provisional application No. 62/536,266, filed on Jul. 24, 2017, provisional application No. 62/644,233, filed on Mar. 16, 2018, provisional application No. 62/659,060, filed on Apr. 17, 2018, provisional application No. 62/745,194, filed on Oct. 12, 2018, provisional application No. 62/755,241, filed on Nov. 2, 2018.

(51) Int. Cl.
*A63B 1/00* (2006.01)
*A63B 102/32* (2015.01)

(52) U.S. Cl.
CPC ... *A63B 2053/0445* (2013.01); *A63B 2102/32* (2015.10); *A63B 2209/10* (2013.01)

(58) Field of Classification Search
CPC .... A63B 5053/0408; A63B 2053/0441; A63B 53/04; A63B 1/00
USPC ..... 473/257
See application file for complete search history.

(56) References Cited

U.S. PATENT DOCUMENTS 4,043,562 A 8/1977 Shillington
4,340,230 A 7/1982 Churchward
4,754,977 A 7/1988 Sahm
4,869,507 A 9/1989 Sahm
5,137,275 A * 8/1992 Nelson ..... A63B 53/02 473/306
D335,317 S 5/1993 Shearer
D335,692 S 5/1993 Antonious
D336,757 S 6/1993 Antonious
5,275,412 A 1/1994 Innes
D350,582 S 9/1994 Miansian et al.
5,429,366 A 7/1995 McCabe
D363,101 S 10/1995 Sturm
5,454,563 A 10/1995 Nagamoto
5,489,097 A 2/1996 Simmons
D368,751 S 4/1996 Rife
D369,393 S 4/1996 Yutaka
D365,864 S 10/1996 Strum
5,571,053 A 11/1996 Lane
D378,688 S 4/1997 Cameron, Jr.
D385,609 S 10/1997 Cameron
5,683,307 A 11/1997 Rife
D388,143 S 12/1997 Huan-Chiang
D389,207 S 1/1998 Cameron
5,720,671 A * 2/1998 Cheng ..... A63B 53/02 473/305
D398,685 S 9/1998 Masuda
D399,290 S 10/1998 Sizemore, Jr.
D399,911 S 10/1998 Sanchez
5,839,974 A 11/1998 McAllister
D405,836 S 2/1999 Nicolette et al.
D409,701 S 5/1999 Ashcraft et al.
5,924,938 A 7/1999 Hines
6,007,434 A 12/1999 Baker
6,039,656 A 3/2000 Fireman
D422,655 S 4/2000 Hicks
6,050,903 A 4/2000 Lake
D426,276 S 6/2000 Besnard et al.
D431,854 S 10/2000 Cameron
D432,192 S 10/2000 Hicks
D436,151 S 1/2001 Nicolette et al.
D437,374 S 2/2001 Cameron
D441,820 S 5/2001 Nicolette et al.
D443,668 S 6/2001 Nicolette et al.
D443,905 S 6/2001 Nicolette et al.
D444,833 S 7/2001 Nicolette
6,264,571 B1 7/2001 Lekavich
D449,664 S 10/2001 Beebe et al.
D449,865 S 10/2001 Fife, Jr. et al.
D450,799 S 11/2001 Nicolette et al.
D451,973 S 12/2001 Wells et al.
6,348,014 B1 2/2002 Chiu
6,354,959 B1 3/2002 Nicolette
6,394,910 B1 5/2002 McCarthy
D472,949 S 4/2003 Serrano
D474,821 S 5/2003 Wells et al.
D474,949 S 5/2003 Schaffeld et al.
D483,086 S 12/2003 Schweigert
6,659,883 B2 12/2003 Nelson
D486,872 S 2/2004 Schweigert et al.
D488,200 S 4/2004 Morgulis
D498,276 S 11/2004 Schweigert et al.
6,902,496 B2 6/2005 Solheim
D512,116 S 11/2005 Miraflor et al.
6,988,956 B2 1/2006 Cover
6,997,819 B2 * 2/2006 Naylor ..... A63B 60/00 473/309
D520,088 S 5/2006 Parr
7,077,760 B2 7/2006 Gray
D531,242 S 10/2006 Wayne
D532,067 S 11/2006 Soracco
7,153,220 B2 12/2006 Lo
D534,595 S 1/2007 Hasebe
7,156,752 B1 1/2007 Bennett
D536,401 S 2/2007 Kawami
D536,403 S 2/2007 Kawami
D538,371 S 3/2007 Kawami
7,201,668 B1 4/2007 Pamias
7,204,765 B2 4/2007 Cover
D542,869 S 5/2007 Adams
D543,598 S 5/2007 Kuan et al.
D543,601 S 5/2007 Kawami
D555,219 S 11/2007 Lin
D556,277 S 11/2007 Broom
7,309,297 B1 12/2007 Solari
D561,854 S 2/2008 Morris
7,331,876 B2 2/2008 Klein
7,351,162 B2 4/2008 Soracco
D569,461 S 5/2008 Morris
D569,930 S 5/2008 Nehrbas
7,396,289 B2 7/2008 Soracco
D577,086 S 8/2008 Nicolette et al.
7,416,494 B2 8/2008 Edel
D577,085 S 9/2008 Nicolette et al.
D579,506 S 10/2008 Nicolette et al.
D579,995 S 11/2008 Nicolette et al.
D582,497 S 12/2008 Rollinson
7,473,189 B2 1/2009 Schweigert
7,491,131 B2 2/2009 Vinton
D595,793 S 7/2009 Rollinson
D599,425 S 9/2009 Laub
D600,763 S 9/2009 Cameron
7,744,485 B2 6/2010 Jones
D620,993 S 8/2010 Laub
D621,461 S 8/2010 Serrano
D623,709 S 9/2010 Serrano et al.
D631,925 S 2/2011 Broom
7,887,432 B2 2/2011 Jones
7,909,707 B2 3/2011 Klein
7,918,745 B2 4/2011 Morris
D638,891 S 5/2011 Nicolette et al.
D642,643 S 8/2011 Nicolette et al.
D643,485 S 8/2011 Nicolette et al.
D645,104 S 9/2011 Nicolette et al.
8,096,039 B2 1/2012 Soracco
D653,718 S 2/2012 Stokke et al.
D661,753 S 6/2012 Cameron et al.
D666,260 S 8/2012 Cynn
8,371,958 B2 2/2013 Treadwell
8,376,878 B2 2/2013 Bennett
D688,339 S 8/2013 Hilton et al.
D688,341 S 8/2013 Rollinson
D691,226 S 10/2013 Hilton et al.
D699,308 S 2/2014 Rollinson
8,696,492 B1 4/2014 Hocknell

(56) References Cited

U.S. PATENT DOCUMENTS

| | | | | |
|---|---|---|---|---|
| D704,782 | S | 5/2014 | Rollinson | |
| 8,721,472 | B2 | 5/2014 | Kuan | |
| 8,790,193 | B2 | 7/2014 | Serrano | |
| D711,483 | S | 8/2014 | Wong | |
| D715,388 | S | 10/2014 | Serrano | |
| D722,350 | S | 2/2015 | Schweigert | |
| D722,351 | S | 2/2015 | Parsons et al. | |
| D722,352 | S | 2/2015 | Nicolette et al. | |
| D723,120 | S | 2/2015 | Nicolette | |
| D724,164 | S | 3/2015 | Schweigert et al. | |
| D725,208 | S | 3/2015 | Schweigert | |
| D726,265 | S | 4/2015 | Nicolette | |
| D726,846 | S | 4/2015 | Schweigert | |
| D730,462 | S | 5/2015 | Becktor | |
| D732,122 | S | 6/2015 | Becktor | |
| D732,618 | S | 6/2015 | Nivanh | |
| D733,234 | S | 6/2015 | Nicolette | |
| D738,447 | S | 9/2015 | Schweigert | |
| D738,449 | S | 9/2015 | Schweigert | |
| D739,487 | S | 9/2015 | Schweigert | |
| D741,426 | S | 10/2015 | Schweigert | |
| D748,213 | S | 1/2016 | Parsons et al. | |
| D748,215 | S | 1/2016 | Parsons et al. | |
| D753,252 | S | 4/2016 | Schweigert | |
| 9,808,680 | B1 | 11/2017 | Myers | |
| 2002/0077193 | A1* | 6/2002 | Takeda | A63B 53/02 473/305 |
| 2003/0199332 | A1* | 10/2003 | Lindsay | A63B 53/02 473/305 |
| 2004/0014532 | A1 | 1/2004 | Lee | |
| 2004/0138003 | A1 | 7/2004 | Grace | |
| 2004/0180730 | A1 | 9/2004 | Franklin | |
| 2006/0052178 | A1 | 3/2006 | Franklin | |
| 2006/0094522 | A1 | 5/2006 | Tang | |
| 2006/0223649 | A1 | 10/2006 | Rife | |
| 2007/0129163 | A1 | 6/2007 | Solari | |
| 2007/0135232 | A1 | 6/2007 | Billings | |
| 2007/0142122 | A1 | 6/2007 | Bonneau | |
| 2007/0207875 | A1 | 9/2007 | Kuan | |
| 2007/0238548 | A1 | 10/2007 | Johnson | |
| 2008/0139333 | A1 | 6/2008 | Klein | |
| 2008/0146372 | A1 | 6/2008 | John | |
| 2008/0176672 | A1 | 7/2008 | Roach | |
| 2009/0029800 | A1 | 1/2009 | Jones | |
| 2009/0163287 | A1* | 6/2009 | Vald'Via | A63B 53/02 473/310 |
| 2009/0239678 | A1 | 9/2009 | De La Cruz | |
| 2010/0035700 | A1 | 2/2010 | Yu | |
| 2010/0255922 | A1 | 10/2010 | Lueders | |
| 2011/0165959 | A1 | 7/2011 | Klein | |
| 2013/0165256 | A1 | 6/2013 | Stevenson | |
| 2013/0210537 | A1 | 8/2013 | Ainscough | |
| 2015/0306477 | A1 | 10/2015 | Parsons | |
| 2016/0016050 | A1 | 1/2016 | Rife | |
| 2018/0001163 | A1 | 1/2018 | Becktor | |
| 2018/0361206 | A1* | 12/2018 | Becktor | A63B 53/02 |

OTHER PUBLICATIONS

TourSpecGolf (Gold's Factory Multi Weighted Custom Putter) [online]. Nov. 20, 2010 [retrieved May 8, 2019] Retrieved from the Internet: <URL: http://www .tourspecgolf .com/blog/golds-factory-multi-weighted-custom-putter>.

* cited by examiner

GOLF CLUB HEADS AND METHODS TO MANUFACTURE GOLF CLUB HEADS

CROSS REFERENCE

This application is a continuation-in-part of U.S. application Ser. No. 16/006,055, filed Jun. 12, 2018, which claims the benefit of U.S. Provisional Application No. 62/518,715, filed Jun. 13, 2017, U.S. Provisional Application No. 62/533,481, filed Jul. 17, 2017, U.S. Provisional Application No. 62/536,266, filed Jul. 24, 2017, U.S. Provisional Application No. 62/644,233, filed Mar. 16, 2018, and U.S. Provisional Application No. 62/659,060, filed Apr. 17, 2018.

This application claims the benefit of U.S. Provisional Application No. 62/745,194, filed Oct. 12, 2018, and U.S. Provisional Application No. 62/755,241, filed Nov. 2, 2018.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

The disclosures of the above-mentioned U.S. applications are incorporated herein by reference.

FIELD

The present disclosure generally relates to golf equipment, and more particularly, to golf club heads and methods to manufacturing golf club heads.

BACKGROUND

Golf club heads may be manufactured using various materials and processes. For example, putter heads typically include an integrated hosel. Accordingly, an individual in possession of a putter having an undesirable body type and/or hosel type is forced to acquire a second putter having the desired characteristics. By assembling golf club heads using removable interchangeable parts, some relief may be provided to an individual facing the problem outlined above.

Figure 1:
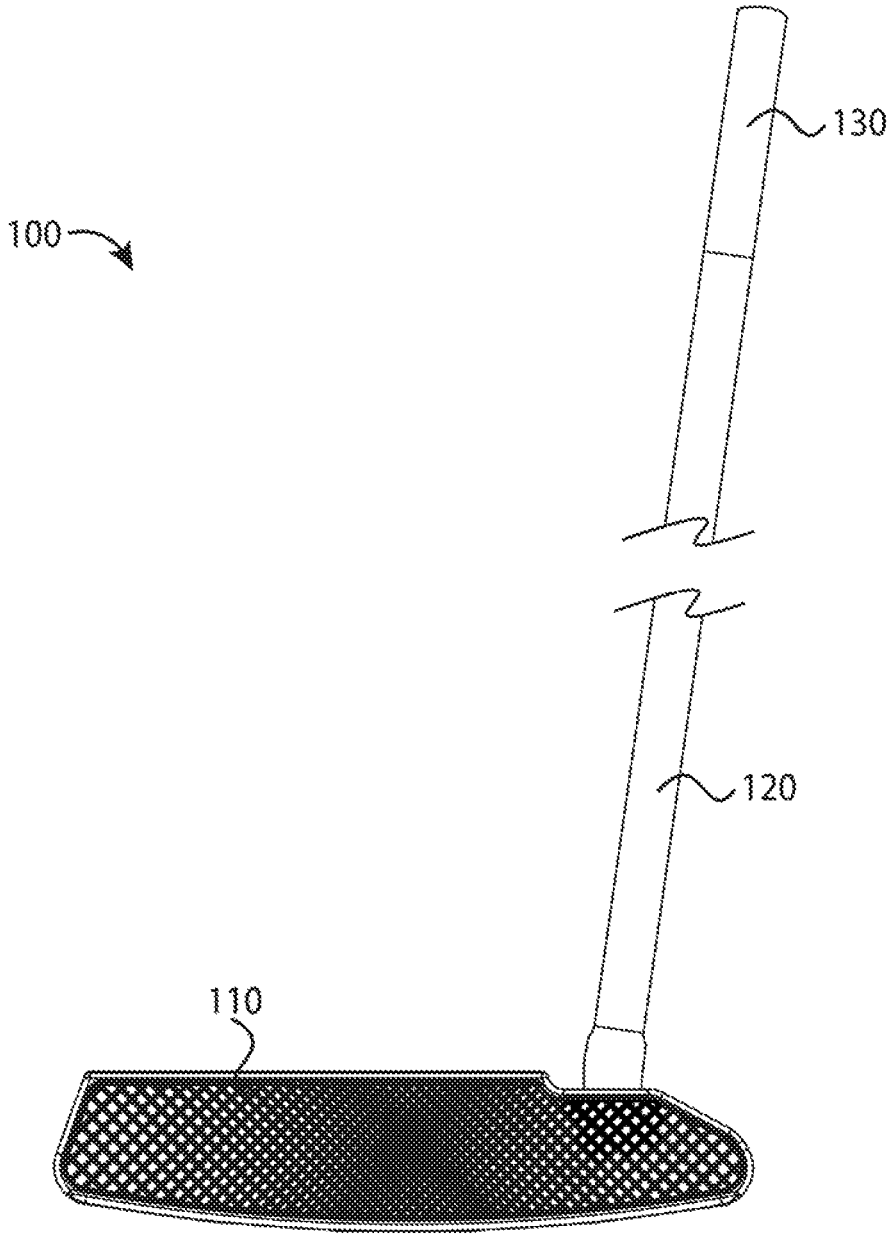
FIG. 1 depicts a front view of a golf club with a golf club head according to an example of the apparatus, methods, and articles of manufacture described herein.
Figure 2:
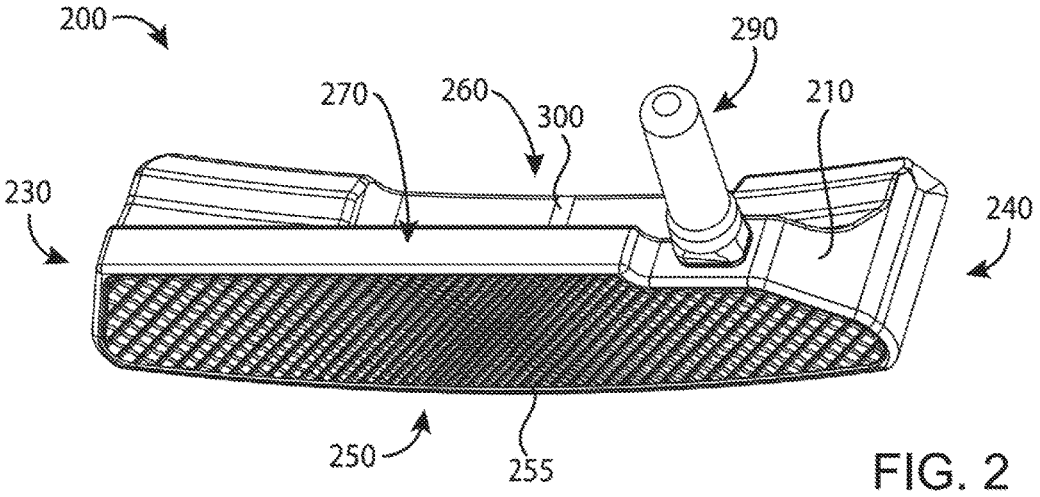
FIG. 2 depicts a front perspective view of a golf club head according to yet another example of the apparatus, methods, and articles of manufacture described herein.
Figure 3:
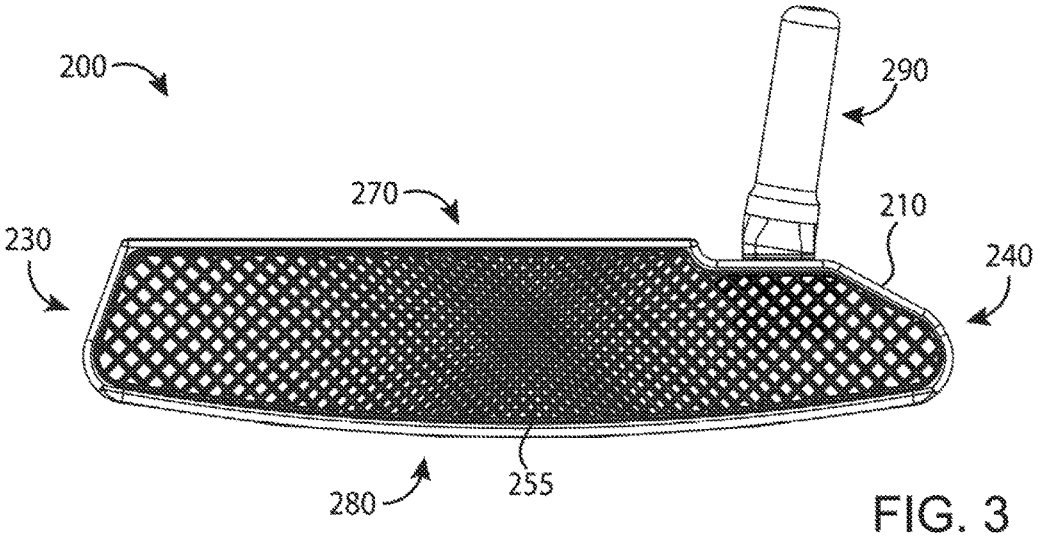
FIG. 3 depicts a front view of the golf club head of FIG. 2.
Figure 4:
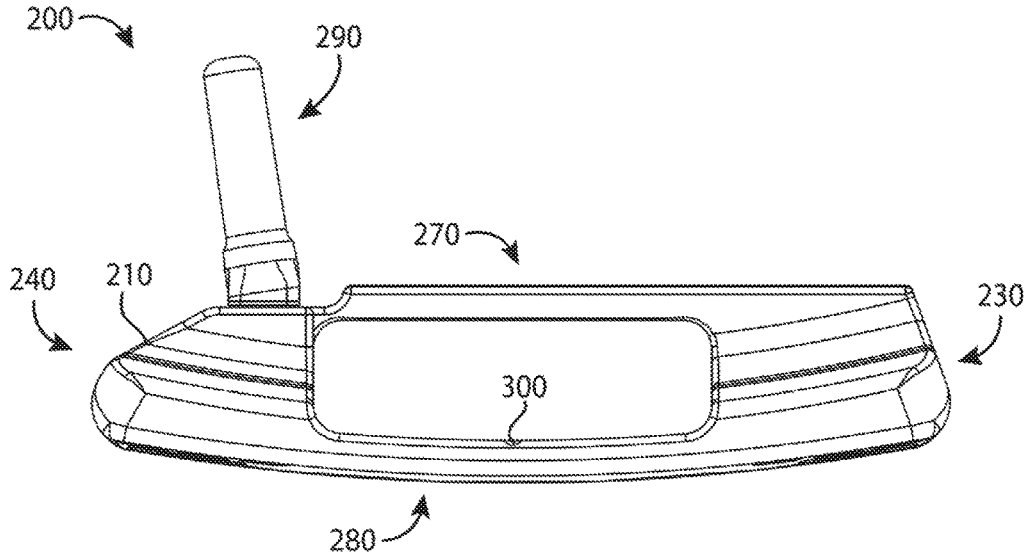
FIG. 4 depicts a rear view of the golf club head of FIG. 2.
Figure 5:
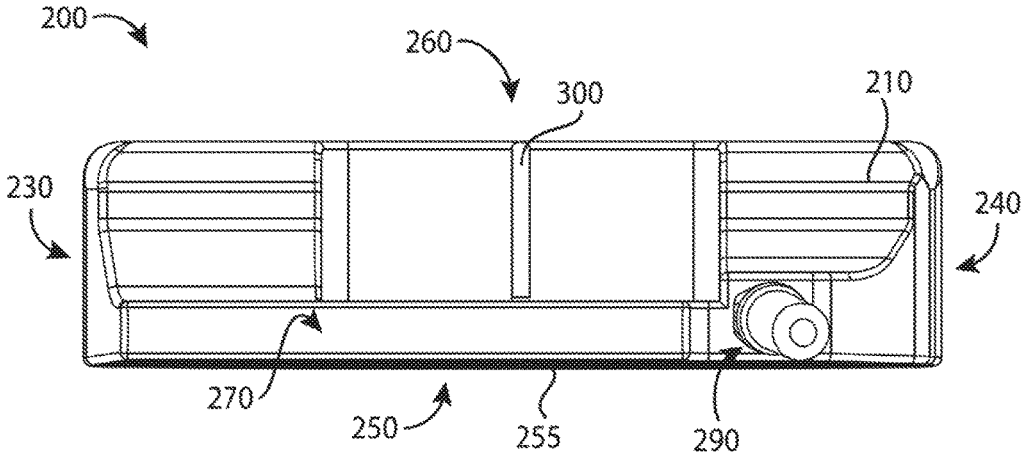
FIG. 5 depicts a top view of the golf club head of FIG. 2.
Figure 6:
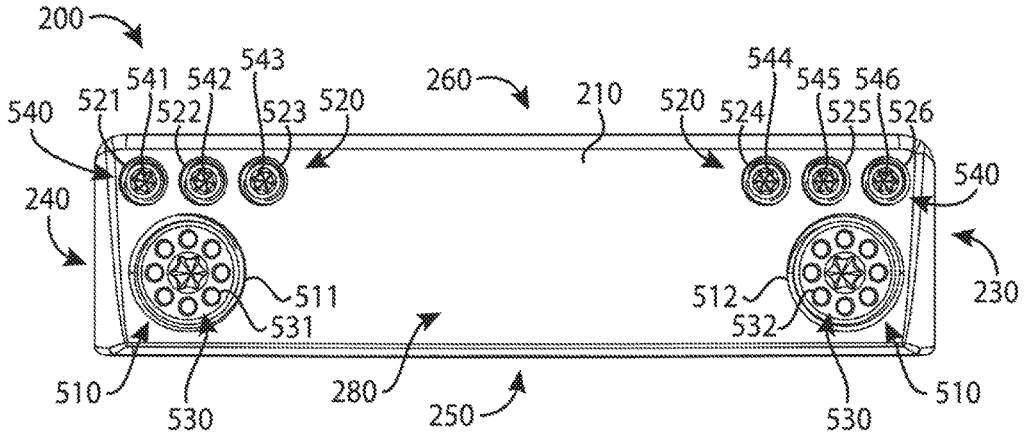
FIG. 6 depicts a bottom view of the golf club head of FIG. 2.
Figure 7:
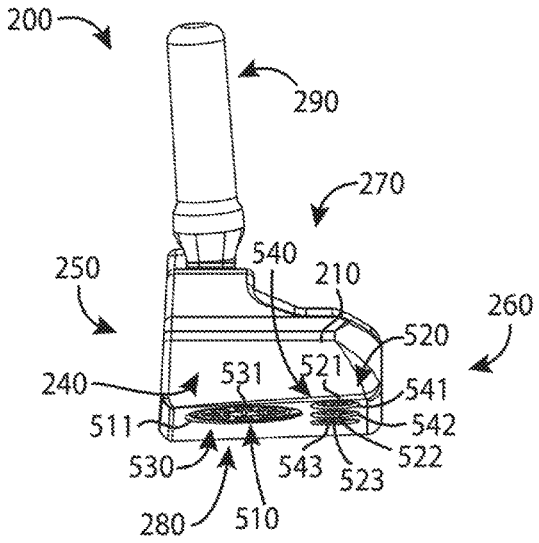
FIG. 7 depicts a left view of the golf club head of FIG. 2.
Figure 8:
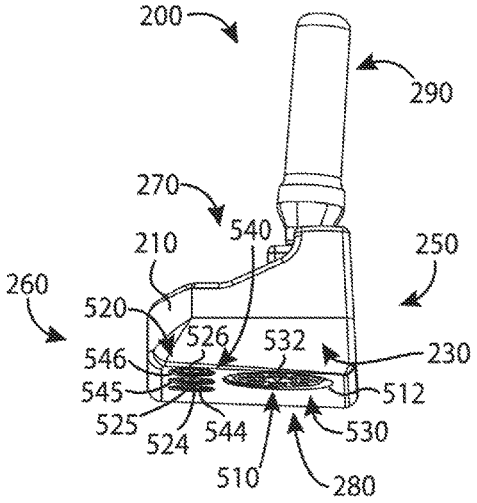
FIG. 8 depicts a right view of the golf club head of FIG. 2.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of examples of the present disclosure.

DESCRIPTION

In general, golf club heads and methods to manufacture golf club heads are described herein. The apparatus, methods, and articles of manufacture described herein are not limited in this regard.

In the example of FIG. 1, a golf club 100 may include a golf club head 110, a shaft 120 extending from the golf club head 110, and a grip 130 at the butt end of the shaft 120. The golf club 100 may be a blade-type putter, a mid-mallet-type putter, a mallet-type putter, or any other putter-type golf club. The particular putter-type may be determined based on an individual's putting stroke. While the golf club 100 is shown in a right-handed configuration, the teachings of the present disclosure may be readily adapted to a left-handed golf club. The apparatus, methods, and articles of manufacture described herein are not limited in this regard.

In the example of FIGS. 2-8, a golf club head 200 similar to the golf club head 110 of FIG. 1 is shown and may include a body portion 210 having a toe portion 230, a heel portion 240, a front portion 250 with a face portion 255 (e.g., a strike face) used to impact a golf ball (not shown), a rear portion 260, a top portion 270, and a sole portion 280. The toe and heel portions 230 and 240, respectively, may be on opposite ends of the body portion 210 and may define a length of the body portion 210. The front and rear portions 250 and 260, respectively, may be on opposite ends of the body portion 210 and may define a width of the body portion 210. The body portion 210 may be partially or entirely made of a steel-based material (e.g., 303 stainless steel), a titanium-based material, a magnesium-based material, an aluminum-based material (e.g., a high-strength aluminum alloy or a composite aluminum alloy coated with a high-strength alloy), a tungsten-based material, any combination thereof, and/or other suitable types of materials. Alternatively, the body portion 210 may be partially or entirely made of a non-metal material (e.g., composite, plastic, etc.). In one example, the body portion 210 may be entirely made of a steel-based material with a Rockwell hardness of 70-90 HRB. In another example, the body portion 210 may be entirely made of an aluminum-based material with a Rockwell hardness of 50-70 HRB. The apparatus, methods, and articles of manufacture described herein are not limited in this regard.

The face portion 255 may be an integral portion of the body portion 210 (e.g., formed via a milling process). Alternatively, the face portion 255 may be a separate piece or an insert coupled to the body portion 210 via various manufacturing and/or processes (e.g., a bonding process, a welding process, a brazing process, a mechanical locking method, a mechanical fastening method, any combination thereof, or other suitable types of manufacturing methods and/or processes). The face portion 255 may be associated with a loft plane that defines the loft angle of the golf club head 110. The apparatus, methods, and articles of manufacture described herein are not limited in this regard.

The golf club head 200 may also include a hosel portion 290 at the top portion 270 or elsewhere on the body portion 210. The hosel portion 290 may be an integral portion of the body portion 210. Alternatively, the hosel portion 290 may be a separate piece coupled to the body portion 210 via various manufacturing and/or processes (e.g., a bonding process, a welding process, a brazing process, a mechanical locking method, a mechanical fastening method, any combination thereof, or other suitable types of manufacturing methods and/or processes). The hosel portion 290 may be partially or entirely made of a steel-based material, a titanium-based material, a magnesium-based material, an aluminum-based material (e.g., a high-strength aluminum alloy or a composite aluminum alloy coated with a high-strength alloy), a tungsten-based material, any combination thereof, and/or other suitable types of materials. Alternatively, the hosel portion 290 may be partially or entirely made of a non-metal material (e.g., composite, plastic, etc.). In one example, the hosel portion 290 may be entirely made of a steel-based material with a Rockwell hardness of 70-90 HRB. In another example, the hosel portion 290 may be entirely made of an aluminum-based material with a Rockwell hardness of 50-70 HRB. Accordingly, the hosel portion 290 may be made from the same material or a different material as the body portion 210. The apparatus, methods, and articles of manufacture described herein are not limited in this regard.

The body portion 210 may include a visual guide portion 300 to aid an individual in lining up the golf club head 200 with his or her intended target line. The visual guide portion 300 may be provided at or proximate the top portion 270 and may extend between the front and rear portions 250 and 260. The visual guide portion 300 is exemplarily shown as a recessed line substantially equidistant from the toe portion 230 and the heel portion 240. The visual guide portion 300 may have a distinct color, marking, and/or other visual feature(s) so as to be visually distinguished from the surrounding portions of the body portion 210. In other examples (not shown), the body portion 210 may be configured with more than one visual guide portion. Alternatively, the body portion 210 may be configured with no visual guide portion at all. The apparatus, methods, and articles of manufacture described herein are not limited in this regard.

The body portion 210 may include a first set of weight ports 510 (e.g., shown as weight ports 511 and 512) and/or a second set of weight ports 520 (e.g., shown as weight ports 521, 522, 523, 524, 525, and 526) at the sole portion 280. The first set of weight ports 510 may be closer to the front portion 250 than to the rear portion 260. One or more weight ports (e.g., shown as weight port 511) of the first set of weight ports 510 may be closer to the heel portion 240 than to the toe portion 230. Additionally or alternatively, one or more weight ports (e.g., shown as weight port 512) may be located closer to the toe portion 230 than to the heel portion 240. The second set of weight ports 520 may be closer to the rear portion 260 than to the front portion 250. One or more weight port (e.g., shown as weight ports 521, 522, and 523) of the second set of weight ports 520 may be closer to the heel portion 240 than to the toe portion 230. The weight ports of the second set of weight ports 520 located closer to the heel portion 240 may be evenly or unevenly spaced to form a dotted line extending between the heel portion 240 and the toe portion 230. Additionally or alternatively, one or more weight port (e.g., shown as weight ports 524, 525, and 526) of the second set of weight ports 520 may be closer to the toe portion 230 than to the heel portion 240. The weight ports of the second set of weight ports 520 located closer to the toe portion 230 may be evenly or unevenly spaced to form a dotted line extending between the toe portion 230 and the heel portion 240. The weight ports of the second set of weight ports 520 may be linearly aligned and may be parallel or substantially parallel with the face portion 255. The apparatus, methods, and articles of manufacture described herein are not limited in this regard.

The first and second set of weight ports 510 and 520, respectively, may have similar or different physical properties (e.g., shape, size, etc.). While the weight ports of the first set of weight ports 510 are shown as being larger (e.g., in diameter and volume) than the weight ports of the second set of weight ports 520, the opposite may hold true in alternative examples. Additionally or alternatively, size differences may exist between weight ports of the first set of weight ports 510 and/or between weight ports of the second set of weight ports 520. While the weight ports of the first and second sets of weight ports 510 and 520, respectively, are shown as having a cylindrical shape (e.g., a circular cross-section), any number of weight ports of the first set of weight ports 510 may have a shape that is similar to or different from a shape of any number of weight ports of the second set of weight ports 520. While the weight ports of the first and second sets of weight ports 510 and 520, respectively, are shown in a particular location at the sole portion 280, the location of one or more weight ports of the first set of weight ports 510 and/or the second set of weight ports 520 may be changed in alternative examples. The apparatus, methods, and articles of manufacture described herein are not limited in this regard.

Each weight port of the first set of weight ports 510 may be configured to receive a weight portion of a first set of weight portions 530 (e.g., shown as weight portions 531 and 532). The weight portions of the first set of weight portions 530 may have a cylindrical shape to complement the shape of the weight ports of the first set of weight ports 510. The weight portions of the first set of weight portions 530 may be interchangeable with one another. As such, each weight port of the first set of weight ports 510 may be configured to interchangeably receive any of the weight portions of the first set of weight portions 530. While the first set of weight ports 510 is shown totaling two in number, the first set of weight ports 510 may have more or less than two weight ports in alternative examples. Accordingly, the number of weight portions of the first set of weight portions 530 may increase or decrease to match the number of weight ports of the first set of weight ports 510. In some examples, one or more weight ports of the first set of weight ports 510 may be left unoccupied if desired. The apparatus, methods, and articles of manufacture described herein are not limited in this regard.

Each weight port of the second set of weight ports 520 may be configured to receive a weight portion of a second set of weight portions 540 (e.g., shown as weight portions 541, 542, 543, 544, 545, and 546). The weight portions of the second set of weight portions 540 may have a cylindrical shape to complement the shape of the weight ports of the second set of weight ports 520. The weight portions of the second set of weight portions 540 may be interchangeable with one another. As such, each weight port of the second set of weight ports 520 may be configured to interchangeably receive any of the weight portions of the second set of weight portions 540. While the second set of weight ports 520 is shown totaling six in number, the second set of weight ports 520 may have more or less than six weight ports in alternative examples. Accordingly, the number of weight portions of the second set of weight portions 540 may increase or decrease to match the number of weight ports of the second set of weight ports 520. In some examples, one or more weight ports of the second set of weight ports 520 may be left unoccupied if desired. The apparatus, methods, and articles of manufacture described herein are not limited in this regard.

The first and second sets of weight portions 530 and 540, respectively, may have similar or different physical properties (e.g., color, shape, size, density, mass, volume, etc.). As a result, the first and second sets of weight portions 530 and 540, respectively, may contribute to the functional and/or ornamental design of the golf club head 200. For example, the first and second sets of weight portions 530 and 540, respectively, may be partially or entirely made of a high-density material such as a tungsten-based material or other suitable types of materials. In the example of FIGS. 2-8, the first and second sets of weight portions 530 and 540, respectively, may be tungsten-allow screws. In another example, the first and second sets of weight portions 530 and 540, respectively, may be made of a tungsten-based material, a steel-based material, a titanium-based material, or any combination thereof. In yet another example, the first and second sets of weight portions 530 and 540, respectively, may be partially or entirely made of a non-metal material (e.g., composite, plastic, etc.). The apparatus, methods, and articles of manufacture described herein are not limited in this regard.

In the example of FIGS. 9-15, a face portion 900 of a golf club head including any golf club head described herein may include a strike portion 910, a toe portion 930 having a toe edge 931, a heel portion 940 having a heel edge 941, a top portion 970 having a top edge 971, a sole portion 980 having a sole edge 981, and a center strike portion 985. The toe edge 931, the heel edge 941, the top edge 971, and the sole edge 981 may define a periphery or perimeter 990 of the face portion 900. The center strike portion 985 may be located inside the perimeter 990 and may include a geometric center 991 of the face portion 900. In one example, the face portion 900 may be co-manufactured with a body portion (e.g., body portion 210) of a golf club head (e.g., golf club head 200) to be an integral part of the body portion of the golf club head (e.g., milling and/or other techniques such as grinding, etching, laser milling, etc. to the body portion). In another example, the face portion 900 may be a separate piece from a body portion of a golf club and attached to the body portion by welding, soldering, adhesive bonding, press fitting, and/or other suitable attachment methods. In yet another example, the face portion 900 may be a separate piece from a body portion of a golf club head and attached to the body portion by one or more fasteners such as bolts and/or screws. The apparatus, methods, and articles of manufacture described herein are not limited in this regard.

The strike portion 910 of the face portion 900 may partially or entirely include a plurality of projections 1000 (e.g., two projections generally shown in FIGS. 9-13 as 1001 and 1002). In the example of FIGS. 9-15, the entire strike portion 910 of the face portion 80 may include the plurality of projections 1000. In another example, the strike portion 910 of the face portion 900 may partially include the plurality of projections 1000. In one example, the face portion 900 may be a separate piece and the strike portion 910 may be located opposite a back portion 1010 (FIG. 11) of the face portion 900. The back portion 1010 may be coupled to and/or in contact with a filler material that may at least partially structurally support the face portion 900, dampen noise, and/or reduce vibration when the face portion 900 strikes a golf ball as described herein. The apparatus, methods, and articles of manufacture described herein are not limited in this regard.

Figure 11:
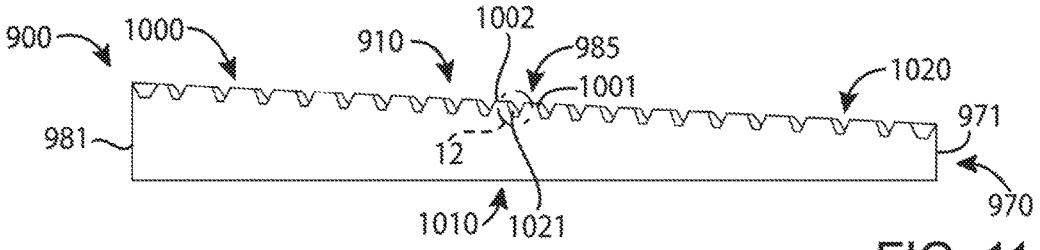
FIG. 11 depicts a cross-sectional view of the face portion taken at lines 11-11 of FIG. 10.
Figure 12:
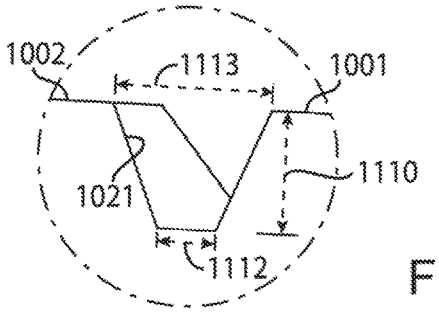
FIG. 12 depicts an enlarged view of area 12 of the face portion of FIG. 11.
Figure 13:
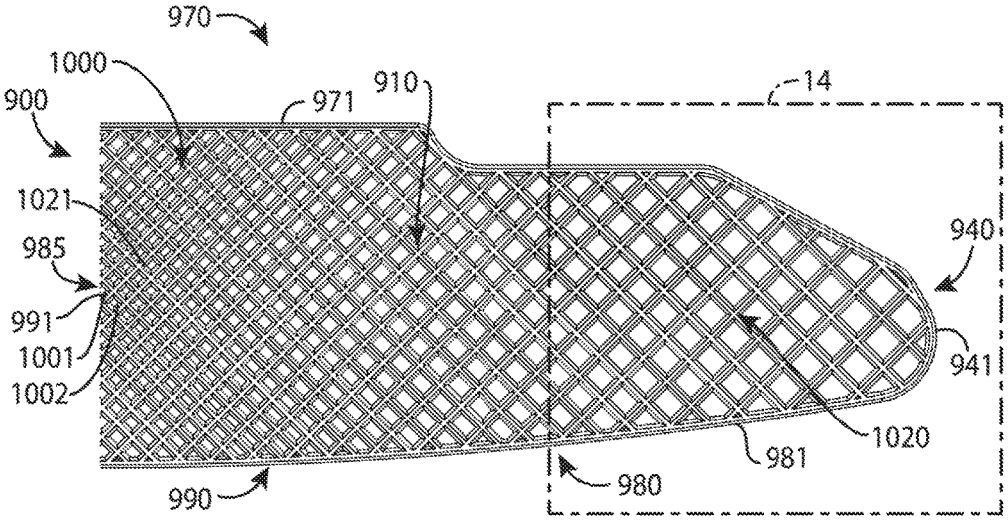
FIG. 13 depicts an enlarged view of area 13 of the face portion of FIG. 9.

In the example of FIGS. 9-15, each one of the plurality of projections 1000 may be separated from and linearly aligned with an adjacent projection by one of a plurality of grooves 1020 (e.g., one groove generally shown in FIGS. 11-13 as 1021). The plurality of grooves 1020 may be arranged on the strike portion 910 of the face portion 900 in a grid pattern with each grid cell corresponding to one of the plurality of projections 1000 (e.g., one projection shown in FIG. 15 as 1001). In other words, the plurality of projections 1000 may be configured on the strike portion 910 of the face portion 900 in an array defined by the plurality of grooves 1020. The apparatus, methods, and articles of manufacture described herein are not limited in this regard.

Figure 14:
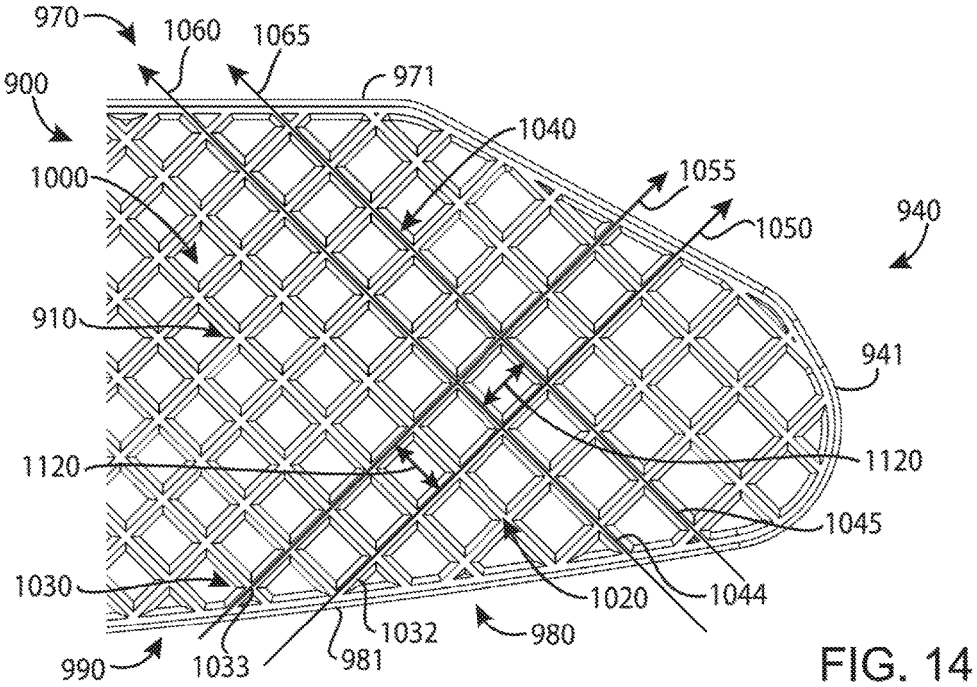
FIG. 14 depicts an enlarged view of area 14 of the face portion of FIG. 13.

The plurality of grooves 1020 may include a first plurality of grooves 1030 (FIG. 14) and a second plurality of grooves 1040 (FIG. 14). The first plurality of grooves 1030 may include two or more grooves (e.g., generally shown in FIG. 14 as grooves 1032 and 1033) extending across the strike portion 910 in a first direction (e.g., as indicated in FIG. 14 by direction arrows 1050 and 1055 associated with grooves 1032 and 1033, respectively). The second plurality of grooves 1040 may include two or more grooves (e.g., generally shown in FIG. 14 as grooves 1044 and 1045) extending across the strike portion 910 in a second direction (e.g., as indicated in FIG. 14 by direction arrows 1060 and 1065 associated with grooves 1044 and 1045, respectively). The second direction may be different from the first direction. In one example, the second direction may be transverse to the first direction. Each one of the first plurality of grooves 1030 (e.g., groove 1032) may be linear and may be parallel or substantially parallel with each other one of the first plurality of grooves 1030 (e.g., groove 1033). Similarly, each one of the second plurality of grooves 1040 (e.g., groove 1044) may be linear and may be parallel or substantially parallel with each other one of the second plurality of grooves 1040 (e.g., groove 1045). In another example (not shown), each one of the first plurality of grooves 1030 (e.g., groove 1032) may be non-linear and/or non-parallel with each other one of the first plurality of grooves 1030. Similarly, each one of the second plurality of grooves 1040 (e.g., groove 1044) may be non-linear and/or non-parallel with each other one of the second plurality of grooves 1040 (e.g., groove 1045). The first plurality of grooves 1030 may intersect with the second plurality of grooves 1040. In one example, one or more grooves of the first plurality of grooves 1030 and one or more grooves of the second plurality of grooves 1040 may intersect a horizontal centerline axis 1070 (FIG. 9) of the face portion 900 at a 45 degree angle. In another example, one or more grooves of the first plurality of grooves 1030 and one or more grooves of the second plurality of grooves 1040 may intersect the horizontal centerline axis 1070 at a 60 degree angle. In yet another example, one or more grooves of the first plurality of grooves 1030 and one or more grooves of the second plurality of grooves 1040 may intersect the horizontal centerline axis 1070 at a 30 degree angle. In yet another example, one or more grooves of the first plurality of grooves 1030 and one or more grooves of the second plurality of grooves 1040 may intersect the horizontal centerline axis 1070 at any angle. The apparatus, methods, and articles of manufacture described herein are not limited in this regard.

As generally indicated in FIG. 14 by direction arrows 1050 and 1055, the first direction may include a first diagonal direction extending upwardly from left-to-right across the face portion 900. Accordingly, the first plurality of grooves 1030 may include grooves of the plurality of grooves 1020 extending in the first direction between the toe edge 931 and the top edge 971, between the sole edge 981 and the top edge 971, and between the sole edge 981 and the heel edge 941. The second direction, as generally indicated in FIG. 14 by direction arrows 1060 and 1065, may include a second diagonal direction extending upwardly from right-to-left across the strike portion 910 of the face portion 900. Accordingly, the second plurality of grooves 1040 may include grooves of the plurality of grooves 1020 extending in the second direction between the heel edge 941 and the top edge 971, between the sole edge 981 and the top edge 971, and between the sole edge 981 and the toe edge 931. The apparatus, methods, and articles of manufacture described herein are not limited in this regard.

Figure 15:
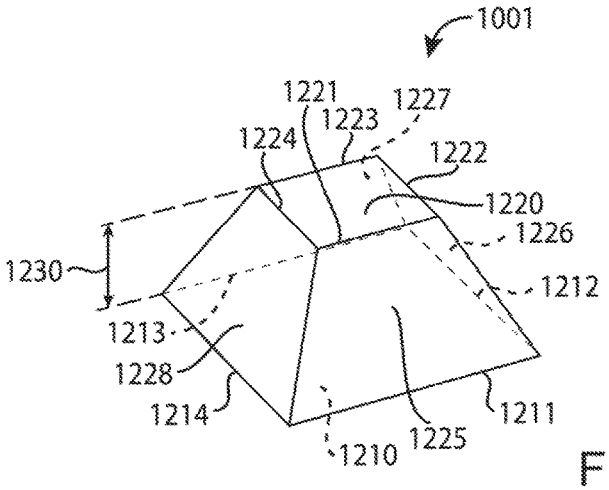
FIG. 15 depicts a perspective schematic view of a projection of the face portion of FIG. 9.

In one example, as shown in FIG. 12, a groove, generally shown as groove 1021, may have a truncated V-shaped cross section, or said differently, an inverted trapezoidal cross section. The groove 1021 may have a depth 1110 and a variable width that transitions from a lowermost width 1112 to an uppermost width 1113. In one example, the width of the groove 1021 linearly transitions from the lowermost width 1112 to the uppermost width 1113. The depth 1110 may be greater than or equal to approximately 0.010 inch (0.254 millimeters) and less than or equal to approximately 0.020 inch (0.508 millimeters). The lowermost width 1112, as measured between base portions (e.g., a base portion 1210 of projection 1001 is shown in FIG. 15) of adjacent projections (e.g., projections 1001 and 1002) of the plurality of projections 1000, may be greater than or equal to approximately 0.010 inch (0.254 millimeters) and less than or equal to approximately 0.012 inch (0.305 millimeters). The uppermost width 1113, as measured between peak portions (e.g., a peak portion 1220 of projection 1001 is shown in FIG. 15) of adjacent projections (e.g., projections 1001 and 1002), may be greater than or equal to approximately 0.021 inch (0.533 millimeters) and less than or equal to approximately 0.036 inch (0.914 millimeters). The apparatus, methods, and articles of manufacture described herein are not limited in this regard.

Each groove of the plurality of grooves 1020 may have a cross section similar to groove 1021 (see FIG. 12). As described herein, the plurality of projections 1000 may be defined by the arrangement of the plurality of grooves 1020. In one example, the resulting geometric shape of each one of the plurality of projections 1000 may be a pyramidal frustum. The distance between adjacent projections of the plurality of projections 1000 may be defined by the width of a groove of the plurality of grooves 1020 extending therebetween. For example, the distance between adjacent projections 1001 and 1002 of the plurality of projections 1000 may be defined by the width of groove 1021 of the plurality of grooves 1020. In one example, each groove of the plurality of grooves 1020 may have the same or substantially the same width, whether the width be constant or variable. Accordingly, distances between adjacent projections of the plurality of projections 1000 may be similar or substantially similar. In another example (not shown), some or all of the grooves of the plurality of grooves 1020 may have different widths. Accordingly, the distance between adjacent projections of the plurality of projections 1000 may also be different. The apparatus, methods, and articles of manufacture described herein are not limited in this regard.

While not shown, the face portion 900 may be configured such that one or more of the plurality of projections 1000 have other geometric shapes. For example, one or more of the plurality of projections 1000 may be a cube or cuboid. Accordingly, the corresponding grooves of the plurality of grooves 1020 may be an intersecting array of grooves that define one or more cubic or cuboidal grid cells. In another example, one or more of the plurality of projections 1000 may be a triangular pyramidal frustum. Accordingly, the corresponding grooves of the plurality of grooves 1020 may be an intersecting array of grooves that define one or more triangular grid cells. In yet another example, one or more of the plurality of projections 1000 may be a pentagonal pyramidal frustum. Accordingly, the corresponding grooves of the plurality of grooves 1020 may be an intersecting array of grooves that define one or more pentagonal grid cells. In yet another example, one or more of the plurality of projections 1000 may be a hexagonal pyramidal frustum. Accordingly, the corresponding grooves of the plurality of grooves 1020 may be an intersecting array of grooves that define one or more hexagonal grid cells. In yet another example, one or more of the plurality of projections 1000 may be any regular or irregular polygonal pyramidal frustum. In yet another example, one or more of the plurality of projections 1000 may be a conical frustum (e.g., having circular or elliptical base portion). The apparatus, methods, and articles of manufacture described herein are not limited in this regard.

In one example, as shown in FIG. 15, a projection, generally shown as projection 1001, may be a square or rectangular pyramidal frustum having a base portion 1210 proximal to the face portion 900, a peak portion 1220 distal to the face portion 900, and a height 1230. The base portion 1210 may include edges 1211, 1212, 1213, and 1214, and the peak portion 1220 may include edges 1221, 1222, 1223, and 1224. The length of edge 1211 or edge 1213 of the base portion 1210 may correspond to a distance (e.g., distance 1120 in FIG. 14) separating two successive grooves of one of the first plurality of grooves 1030 and the second plurality of grooves 1040. The length of edge 1212 or edge 1214 of the base portion 1210 may correspond to the distance separating two successive grooves of the other one of the first plurality of grooves 1030 and the second plurality of grooves 1040. The base portion 1210 may be connected to the peak portion 1220 via at least one side wall generally shown as side walls 1225, 1226, 1227, and 1228. The peak portion 1220 may be flat or textured and may have a smaller area than the base portion 1210. Accordingly, the projection 1001 may taper in a direction from the base portion 1210 to the peak portion 1220. For example, each of the side walls 1225, 1226, 1227, and 1228, respectively, may be trapezoidal and may extend inwardly from the base portion 1210 to the peak portion 1220. Said differently, the area of the projection 1001 may gradually diminish when transitioning from the base portion 1210 to the peak portion 1220. The apparatus, methods, and articles of manufacture described herein are not limited in this regard.

Each projection of the plurality of projections 1000 may be oriented on the face portion 900 such that the diagonals of the corresponding base portion 1210 and peak portion 1220 generally point in horizontal and vertical directions along the face portion 900 when directly viewing the strike portion 910. Accordingly, the projections of the plurality of projections 1000 may be linearly aligned in one or more diagonal directions across the strike portion 910 of the face portion 900. Linearly aligned projections of the plurality of projections 1000 may extend diagonally from the toe portion 930 to the top portion 970, from the toe portion 930 to the sole portion 980, from the top portion 970 to the sole portion 980, from the heel portion 940 to the top portion 970, from the heel portion 940 to the sole portion 980, or a combination thereof. As described herein, the grooves of the plurality of grooves 1020 may also extend diagonally from the toe portion 930 to the top portion 970, from the toe portion 930 to the sole portion 980, from the top portion 970 to the sole portion 980, from the heel portion 940 to the top portion 970, from the heel portion 940 to the sole portion 980, or a combination thereof. Additionally, or alternatively, the projections of the plurality of projections 1000 and the grooves of the plurality of grooves 1020 may be vertically and/or horizontally configured on the strike portion 910 of the face portion 900. For example, at least a portion of the projections of the plurality of projections 1000 may be substantially aligned in one or more horizontal and/or vertical directions across the strike portion 910 of the face portion 900. In another example, the projections of the plurality of projections 1000 and the grooves of the plurality of grooves 1020 may have curved configurations on the strike portion 910 of the face portion 900. The apparatus, methods, and articles of manufacture described herein are not limited in this regard.

The sizes (e.g., volumes) of the plurality of projections 1000 may change in any direction moving from the center strike portion 985 to the perimeter 990 of the face portion 900. In one example, the areas of the peak portions 1220 of the plurality of projections 1000 may successively increase in any direction moving from the central portion 985 to the perimeter 990 of the face portion 900. Additionally, or alternatively, the areas of the base portions 1210 of the plurality of projections 1000 may successively increase in any direction moving from the center strike portion 985 to the perimeter 990 of the face portion 900. Accordingly, a smallest one of the plurality of projections 1000 (e.g., projection 1001) may be located at the center strike portion 985, and more particularly, at or proximate the geometric center 991 of the face portion 900, whereas a largest one of the plurality of projections 1000 may be located farthest from the center strike portion 985, typically at or proximate the toe edge 931 and/or the heel edge 941. The apparatus, methods, and articles of manufacture described herein are not limited in this regard.

Figure 9:
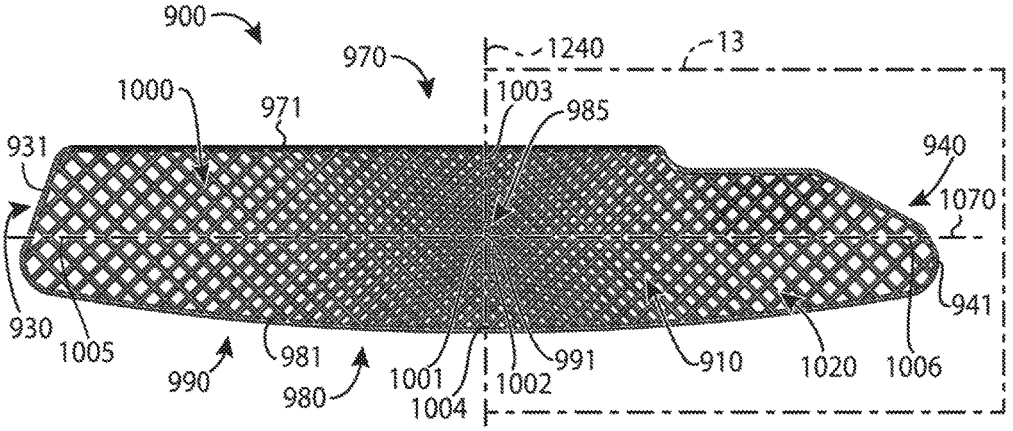
FIG. 9 depicts a front view of a face portion of a golf club head according to an example of the apparatus, methods, and articles of manufacture described herein.
Figure 10:
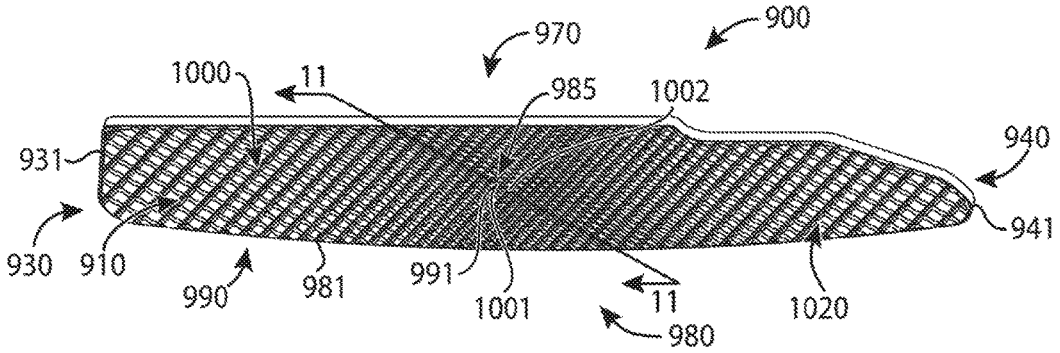
FIG. 10 depicts a front and top perspective view of the face portion of FIG. 9.

At least two projections of the plurality of projections 1000 may have similar sizes if they are located on a line passing through the geometric center 991 and are equidistant to the geometric center 991. For purposes of illustration, FIG. 9 shows a vertical centerline axis 1240 extending between the top edge 971 and the sole edge 981 and passing through the geometric center 991. FIG. 9 also shows the horizontal centerline axis 1070 extending between the toe edge 931 and the heel edge 941 and passing through the geometric center 991. At least two projections of the plurality of projections 1000 may have similar sizes due to being located on the vertical centerline axis 1240 and equidistant to the geometric center 991. For example, the two projections of the plurality of projections 1000 may include a first projection 1003 on the vertical centerline axis 1240 at or proximate the top edge 971 and a second projection 1004 on the vertical centerline axis 1240 at or proximate the sole edge 981, the first and second projections 1003 and 1004 being equidistant to the geometric center 991. Likewise, at least two projections of the plurality of projections 1000 may have similar sizes if they are located on the horizontal centerline axis 1070 and are equidistant to the geometric center 991. For example, the two projections of the plurality of projections 1000 may include a first projection 1005 on the horizontal centerline axis 1070 at or proximate the toe edge 931 and a second projection 1006 on the horizontal centerline axis 1070 at or proximate the heel edge 941, the first and second projections 1005 and 1006 being equidistant to the geometric center 991. The apparatus, methods, and articles of manufacture described herein are not limited in this regard.

Each one of the plurality of projections 1000 may be a square or rectangular pyramidal frustum of similar height 1230. The total areas of the base portions 1210 and peak portions 1220 of the plurality of projections 1000 may be approximately 2.15 square inches (1387.09 square millimeters) and 1.04 square inches (670.97 square millimeters), respectively. Accordingly, the total areas of the peak portions 1220 may be less than half the total areas of the base portions 1210. Alternatively, the total areas of the peak portions 1220 may be equal to or greater than half the total areas of the base portions 1210. As described herein, the smallest one of the plurality of projections 1000 (e.g., projection 1001) may be located at the center strike portion 985 and may be located at or proximate the geometric center 991 of the face portion 900. In one example, an area ratio between the base portion 1210 and the peak portion 1220 of the smallest one of the plurality of projections 1000 may be approximately 4.16 or more generally ranging from 4.0 to 5.0. However, area ratios outside the foregoing range are also possible. The largest one of the plurality of projections 1000 on the vertical centerline axis 1240 of the face portion 900 may be located at or proximate the top edge 971 and/or the sole edge 981. For example, the largest one of the plurality of projections 1000 on the vertical centerline axis 1240 may correspond to two projections (e.g., projections 1003 and 1004) equidistant to the geometric center 991 of the face portion 900 and oppositely located at or proximate the top edge 971 and the sole edge 981, respectively. In one example, the area ratio between the base portion 1210 and the peak portion 1220 belonging to the largest one of the plurality of projections 1000 on the vertical centerline axis 1240 may be approximately 2.68 or more generally ranging from 2.0 to 3.0. However, area ratios outside the foregoing range are also possible. The largest one of the plurality of projections 1000 on the horizontal centerline axis 1070 of the face portion 900 may be located at or proximate the toe edge 931 and/or the heel edge 941. For example, the largest one of the plurality of projections 1000 located on the horizontal centerline axis 1070 may correspond to two projections (e.g., projections 1005 and 1006) equidistant to the geometric center 991 of the face portion 900 and oppositely located at or proximate the toe edge 931 and the heel edge 941, respectively. In one example, the area ratio between the base portion 1210 and the peak portion 1220 belonging to the largest one of the plurality of projections 1000 on the horizontal centerline axis 1070 may be approximately 1.61 or more generally ranging from 1.0 to 2.0. However, area ratios outside the foregoing range are also possible. Accordingly, the area ratio between the base portion 1210 and the peak portion 1220 of a projection of the plurality of projections 1000 may be inversely related to the size of the projection. In other words, the larger a projection is, the smaller is the area ratio between the base portion 1210 and the peak portion 1220 of the projection. Said differently still, in examples where the base portions 1210 and the peak portions 1220 of the plurality of projections 1000 successively increase in any direction moving from the center strike portion 985 to the perimeter 990 of the face portion 900, the corresponding area ratios between the base portions 1210 and the peak portions 1220 of the plurality of projections 1000 may successively decrease in any direction moving from the center strike portion 985 to the perimeter 990 of the face portion 900. The apparatus, methods, and articles of manufacture described herein are not limited in this regard.

At least one of the plurality of projections 1000 may be a different size compared to at least one other projection of the plurality of projections 1000 positioned adjacently leftward, rightward, above, below, or at a diagonal with respect thereto. The difference in sizing between two adjacent projections of the plurality of projections 1000 (e.g., projections 1001 and 1002) may result from differences between the areas of their base portions 1210 and/or peak portions 1220. Additionally, or alternatively, the difference in sizing between two adjacent projections of the plurality of projections 1000 may result from differences in height 1230. A change in size between two or more projections of the plurality of projections 1000 successively aligned in a substantially horizontal, vertical, or diagonal direction across the face portion 900 may be based on a relative proximity between each of the two or more projections of the plurality of projections 1000 and the center strike portion 985. In one example, the two or more successively aligned projections of the plurality of projections 1000 may successively increase in size in the substantially horizontal, vertical, or diagonal direction moving from the center strike portion 985 to the perimeter 990 of the face portion 900. Accordingly, the largest one of the plurality of projections 1000 may be located farthest from the center strike portion 985, generally at or about the perimeter 990 of the face portion 900, and more particularly, at or proximate the toe edge 931 or the heel edge 941 of the face portion 900. The apparatus, methods, and articles of manufacture described herein are not limited in this regard.

In one example, two or more of the plurality of projections 1000 may be similar or substantially similar in height such that the peak portions 1220 associated therewith may each provide a ball striking surface. In another example, the plurality of projections 1000 may increase in height 1230 in one or more directions moving from the center strike portion 985 to the perimeter 990 of the face portion 900. In yet another example, the plurality of projections 1000 may decrease in height in one or more directions moving from the center strike portion 985 to the perimeter 990 of the face portion 900. In yet another example, the plurality of projections 1000 may increase, decrease, or otherwise vary in height in one or more directions on the face portion 900. Accordingly, the depths 1110 of the plurality of grooves 1020 may vary based on the heights 1230 of the plurality of projections 1000, or vice versa. The apparatus, methods, and articles of manufacture described herein are not limited in this regard.

A rate of change of the areas of the peak portions 1220 and/or base portions 1210 of the plurality of projections 1000 may be similar in a direction moving from the center strike portion 985 to the toe edge 931 and in a direction moving from the center strike portion 985 to the heel edge 941. In another example, the rate of change of the areas of the peak portions 1220 and/or base portions 1210 of the plurality of projections 1000 may be similar in a direction moving from the center strike portion 985 to the top edge 971 and in a direction moving from the center strike portion 985 to the sole edge 981. In yet another example, the rate of change of the areas of the peak portions 1220 and/or base portions 1210 of the plurality projections 1000 may be similar in a direction moving from the center strike portion 985 to the toe edge 931, in a direction moving from the center strike portion 985 to the heel edge 941, in a direction moving from the center strike portion 985 to the top edge 971, and in a direction moving from the center strike portion 985 to the sole edge 981. In yet another example, the rate of change of the areas of the peak portions 1220 and/or base portions 1210 of the plurality of projections 1000 may be similar and/or vary in any direction (e.g., horizontal, vertical, diagonal, etc.) moving from the center strike portion 985 to any location on the perimeter 990 of the face portion 900. The apparatus, methods, and articles of manufacture described herein are not limited in this regard.

The change in areas of the peak portions 1220 and/or base portions 1210 of the plurality of projections 1000 in one or more directions moving from the center strike portion 985 to the perimeter 990 of the face portion 900 may be a function of a distance between the location of the plurality of projections 1000 on the face portion 900 and the center strike portion 985. Accordingly, the areas of the peak portions 1220 and/or base portions 1210 of the plurality of projections 1000 may successively increase moving from the center strike portion 985 to the perimeter 990 of the face portion 900 according to a function based on the distance of the projections 1000 from the center strike portion 985. In one example, the change in areas of the peak portions 1220 and/or base portions 1210 of the plurality of projections 1000 in one or more directions moving from the center strike portion 985 to the perimeter 990 of the face portion 900 may be a linear function of a distance between the location of the plurality of projections 1000 on the face portion 900 and the center strike portion 985. In another example, the change in areas of the peak portions 1220 and/or base portions 1210 of the plurality of projections 1000 in one or more directions moving from the center strike portion 985 to the perimeter 990 of the face portion 900 may be a polynomial function (e.g., a quadratic function or cubic function) of a distance between the location of the plurality of projections 1000 on the face portion 900 and the center strike portion 985. The areas of the peak portions 1220 and/or base portions 1210 may vary from the center strike portion 985 to the toe portion 930, the heel portion 940, the top portion 970, and/or the sole portion 980 according to any relationship based on any physical property of the face portion 900 and/or any physical property of a portion of the face portion 900 (e.g., a location on the face portion 900) relative to the center strike portion 985. The apparatus, methods, and articles of manufacture described herein are not limited in this regard.

The change in areas of the peak portions 1220 and/or base portions 1210 of the plurality of projections 1000 in one or more directions moving from the center strike portion 985 to the perimeter 990 of the face portion 900 may be defined by the change in a distance 1120 (FIG. 14) between successive grooves of the first plurality of grooves 1030 extending in the first direction and between successive grooves of the second plurality of grooves 1040 extending in the second direction. In one example, the distance 1120 between successive grooves of the first and second plurality of grooves 1030 and 1040, respectively, may successively increase in any direction moving from the center strike portion 985 to the perimeter 990 of the face portion 900. In other words, the distance 1120 between successive grooves of the first and second plurality of grooves 1030 and 1040, respectively, may successively increase moving from the center strike portion 985 to the toe edge 931, from the center strike portion 985 to the heel edge 941, moving from the center strike portion 985 to the top edge 971, and moving from the center strike portion 985 to the sole edge 981. In one example, the distance 1120 between successive grooves of the first and second plurality of grooves 1030 and 1040, respectively, may increase linearly from the center strike portion 985 to the perimeter 990 of the face portion 900. The distance 1120 between successive grooves of the first and second plurality of grooves 1030 and 1040, respectively, may be a linear function of a distance between the location of the first and second plurality of grooves 1030 and 1040, respectively, on the face portion 900 and the center strike portion 985. In another example, the distance 1120 between successive grooves of the first and second plurality of grooves 1030 and 1040, respectively, may be a polynomial function (e.g., a quadratic function or cubic function) of a distance between the location of the first and second plurality of grooves 1030 and 1040, respectively, on the face portion 900 and the center strike portion 985. In another example, the distance 1120 between successive grooves of the first and second plurality of grooves 1030 and 1040, respectively, may successively increase in one or more directions moving from the center strike portion 985 toward the perimeter 990 of the face portion 900. In other words, the distance 1120 between successive grooves of the first and second plurality of grooves 1030 and 1040, respectively, may successively increase in one or more of the following directions: from the center strike portion 985 to the toe edge 931, from the center strike portion 985 to the heel edge 941, from the center strike portion 985 to the top edge 971, and from the center strike portion 985 to the sole edge 981. In yet another example, the distance 1120 between successive grooves of the first and second plurality of grooves 1030 and 1040, respectively, may successively increase at a similar or different rate in one or more directions moving from the center strike portion 985 toward the perimeter 990 of the face portion 900. Accordingly, the change in the distance 1120 between successive grooves of the first and second plurality of grooves 1030 and 1040, respectively, located at or proximate to the toe portion 930, at or proximate to the heel portion 940, at or proximate to the top portion 970, and/or at or proximate to the sole portion 980 may be similar or may vary. The apparatus, methods, and articles of manufacture described herein are not limited in this regard.

The shape of the plurality of projections 1000, the configuration of the plurality of grooves 1020, and/or the change in size (e.g., increase in area of the peak portions 1220 and/or base portions 1210) of the plurality of projections 1000 from the center strike portion 985 to the perimeter 990 of the face portion 900 may affect ball speed, control, sound, and/or spin. Striking a golf ball with the face portion 900 as described herein may: (1) improve stroke consistency; (2) result in lower ball speeds, which may result in decreased ball roll out distance; (3) result in heel and toe shots having decreased ball speeds, which may also result in shorter ball roll out distance; (4) allow relatively lower and higher handicap players to strike the ball with different locations on the face portion 900; and/or, (5) minimize the amount of ball speed loss for off-center hits toward the toe and/or heel, thereby producing more consistent ball roll out distances for center, toe, and heel shots. The apparatus, methods, and articles of manufacture described herein are not limited in this regard.

In the example of FIGS. 9-15, the plurality of grooves 1020 may be darker than the plurality of projections 1000. A resultant color contrast between the plurality of grooves 1020 and the plurality of projections 1000 may produce an X-shaped visual feature (e.g., see FIG. 1) appearing centrally on the face portion 900 and extending between the top portion 970 and the sole portion 980 of the face portion 900. The X-shaped visual feature may cross over the geometric center 991 of the face portion 900, and as such, may generally indicate a sweet spot of the corresponding golf club head in addition to providing the face portion 900 with a unique and attractive aesthetic. The apparatus, methods, and articles of manufacture described herein are not limited in this regard.

While the example of the face portion 900 shown in FIGS. 9-15 generally includes a plurality of projections 1000 increasing in size in any direction moving from the center strike portion 985 to the perimeter 990 of the face portion 900, other examples (not shown) of the face portion 900 may feature the plurality of projections 1000 decreasing in size in any direction moving from the center strike portion 985 to the perimeter 990 of the face portion 900. For instance, the areas of the peak portions 1220 and/or base portions 1210 may successively decrease in any direction moving from the central portion 985 to the perimeter 990 of the face portion 900. Accordingly, a largest one of the plurality of projections 1000 may be located at the center strike portion 985, and more particularly, at or proximate the geometric center 991 of the face portion 900, whereas a smallest one of the plurality of projections 1000 may be located at or proximate the toe edge 931 and/or the heel edge 941. The apparatus, methods, and articles of manufacture described herein are not limited in this regard.

A rate of change of the areas of the peak portions 1220 and/or base portions 1210 of the plurality of projections 1000 may be similar in a direction moving from the center strike portion 985 to the toe edge 931 and in a direction moving from the center strike portion 985 to the heel edge 941. In another example, the rate of change of the areas of the peak portions 1220 and/or base portions 1210 of the plurality of projections 1000 may be similar in a direction moving from the center strike portion 985 to the top edge 971 and in a direction moving from the center strike portion 985 to the sole edge 981. In yet another example, the rate of change of the areas of the peak portions 1220 and/or base portions 1210 of the plurality of projections 1000 may be similar in a direction moving from the center strike portion 985 to the toe edge 931, in a direction moving from the center strike portion 985 to the heel edge 941, in a direction moving from the center strike portion 985 to the top edge 971, and in a direction moving from the center strike portion 985 to the sole edge 981. In yet another example, the rate of change of the areas of the peak portions 1220 and/or base portions 1210 of the plurality of projections 1000 may be similar and/or vary in any direction (i.e., horizontal, vertical, diagonal, etc.) moving from the center strike portion 985 to any location on the perimeter 990 of the face portion 900. The change in areas of the peak portions 1220 and/or base portions 1210 of the plurality of projections 1000 from the center strike portion 985 to the perimeter 990 of the face portion 900 may be a linear or polynomial function (e.g., a quadratic function or cubic function) of a distance between the location of the plurality of projections 1000 on the face portion 900 and the center strike portion 985. Additionally, or alternatively, the plurality of projections 1000 may decrease in height 1230 at a fixed or variable rate from the center strike portion 985 to the perimeter 990 of the face portion 900. The apparatus, methods, and articles of manufacture described herein are not limited in this regard.

The change in areas of the peak portions 1220 and/or base portions 1210 of the plurality of projections 1000 from the center strike portion 985 to the perimeter 990 of the face portion 900 may be defined by the change in the distance 1120 between successive grooves of the first plurality of grooves 1030 extending in the first direction and between successive grooves of the second plurality of grooves 1040 extending in the second direction. In one example, the distance 1120 between successive grooves of the first and second plurality of grooves 1030 and 1040 may successively decrease in any direction moving from the center strike portion 985 to the perimeter 990 of the face portion 900. In other words, the distance 1120 between successive grooves of the first and second plurality of grooves 1030 and 1040 may successively decrease moving from the center strike portion 985 to the toe edge 931, moving from the center strike portion 985 to the heel edge 941, moving from the center strike portion 985 to the top edge 971, and moving from the center strike portion 985 to the sole edge 981. The distance 1120 between successive grooves of the first and second plurality of grooves 1030 and 1040 may be a linear or polynomial function (e.g., a quadratic function or cubic function) of a distance between the location of the first and second plurality of grooves 1030 and 1040 on the face portion 900 and the center strike portion 985. In another example, the distance 1120 between successive grooves of the first and second plurality of grooves 1030 and 1040 may successively decrease in any direction moving from the center strike portion 985 toward the perimeter 990 of the face portion 900. In other words, the distance 1120 between successive grooves of the first and second plurality of grooves 1030 and 1040 may successively decrease in one or more of the following directions: from the center strike portion 985 to the toe edge 931, from the center strike portion 985 to the heel edge 941, from the center strike portion 985 to the top edge 971, and from the center strike portion 985 to the sole edge 981. The distance 1120 between successive grooves of the first and second plurality of grooves 1030 and 1040 may successively decrease at a similar or different rate in one or more directions moving from the center strike portion 985 toward the perimeter 990 of the face portion 900. Accordingly, the decrease in the distance 1120 between successive grooves of the first and second plurality of grooves 1030 and 1040 located at or proximate to the toe portion 930, at or proximate to the heel portion 940, at or proximate to the top portion 970, and/or at or proximate to the sole portion 980 may be similar or vary. The apparatus, methods, and articles of manufacture described herein are not limited in this regard.

Figure 16:
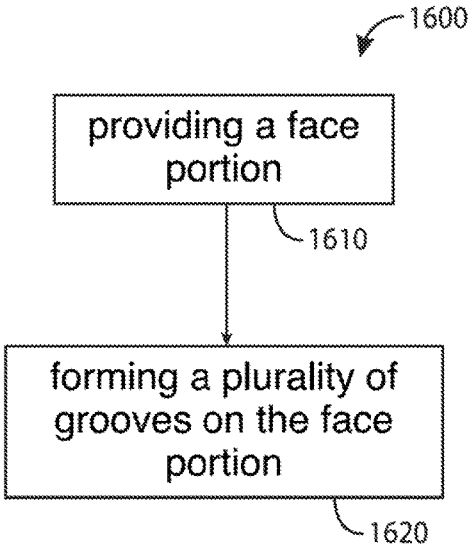
FIG. 16 depicts a method of manufacturing a face portion according to an example of the apparatus, methods and articles of manufacture described herein.
Figure 17:
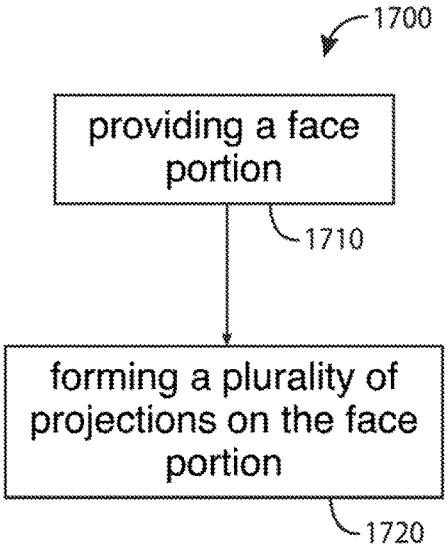
FIG. 17 depicts another method of manufacturing a face portion according to an example of the apparatus, methods and articles of manufacture described herein.

In one example, as shown in FIG. 16, a process 1600 of manufacturing the face portion 900 may include providing a face portion (block 1610) having a planar strike portion (i.e., without any grooves). In one example, the face portion 900 may be an integral part of a golf club head. In another example, the face portion 900 may be a separate face insert that may be coupled to a front portion of a golf club head by using adhesive, tape, welding, soldering, fasteners and/or other suitable methods and devices. The process 1600 may include forming a plurality of grooves on the strike portion of the face portion (block 1620) with distances between successive grooves of the plurality of grooves changing (e.g., increasing or decreasing) in any direction moving from a center strike portion to a perimeter of the face portion. Alternatively, in another example, as shown in FIG. 17, a process 1700 of manufacturing the face portion 900 may include providing a face portion (block 1710) having a planar strike portion (i.e., without any grooves), and forming a plurality projections on the strike portion of the face portion (block 1720) with the size of the plurality of projections changing (e.g., increasing or decreasing) in any direction from a center strike portion to a perimeter of the face portion. As described herein, each one of the plurality of projections may include a peak portion separated from a base portion by a height. In one example, two or more of the plurality of projections may be pyramidal frustums. The change in size may include a change to the areas of the peak portions of the plurality of projections, a change to the areas of the base portions of the plurality of projections, and/or a change in height of the plurality of projections. The apparatus, methods, and articles of manufacture described herein are not limited in this regard.

In one example, the plurality of grooves may be manufactured by milling the face portion. Accordingly, the portions of the face portion that are not milled may form the plurality of projections (e.g., residual portion(s)). In another example, the plurality of grooves may be stamped onto the face portion. In yet another example, the face portion including the plurality of projections and/or the plurality of grooves may be manufactured by forging. In yet another example, the face portion including the plurality of projections and/or the plurality of grooves may be manufactured by casting. In yet another example, the plurality of projections and/or the plurality of grooves may be manufactured by press forming. In yet another example, the plurality of projections and/or the plurality of grooves may be manufactured by laser and/or thermal etching or eroding of the face material. In yet another example, the plurality of projections and/or the plurality of grooves may be manufactured by chemically eroding the face material using photo masks. In yet another example, the plurality of projections and/or the plurality of grooves may be manufactured by electro/chemically eroding the face material using a chemical mask such as wax or a petrochemical substance. In yet another example, the plurality of projections and/or the plurality of grooves may be manufactured by abrading the face material using air or water as the carry medium of the abrasion material such as sand. Any one or a combination of the methods discussed above can be used to manufacture one or more of the plurality of projections and/or the plurality of grooves on the face portion. In some examples, the plurality of projections may be a different color than the plurality of grooves. The apparatus, methods, and articles of manufacture described herein are not limited in this regard.

Figure 18:
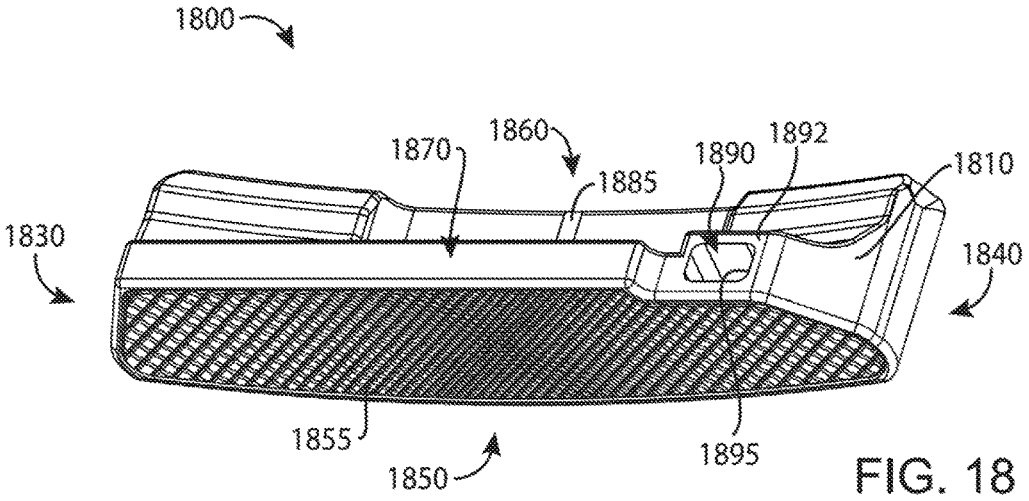
FIG. 18 depicts a front perspective view of a golf club head according to an example of the apparatus, methods, and articles of manufacture described herein.
Figure 19:
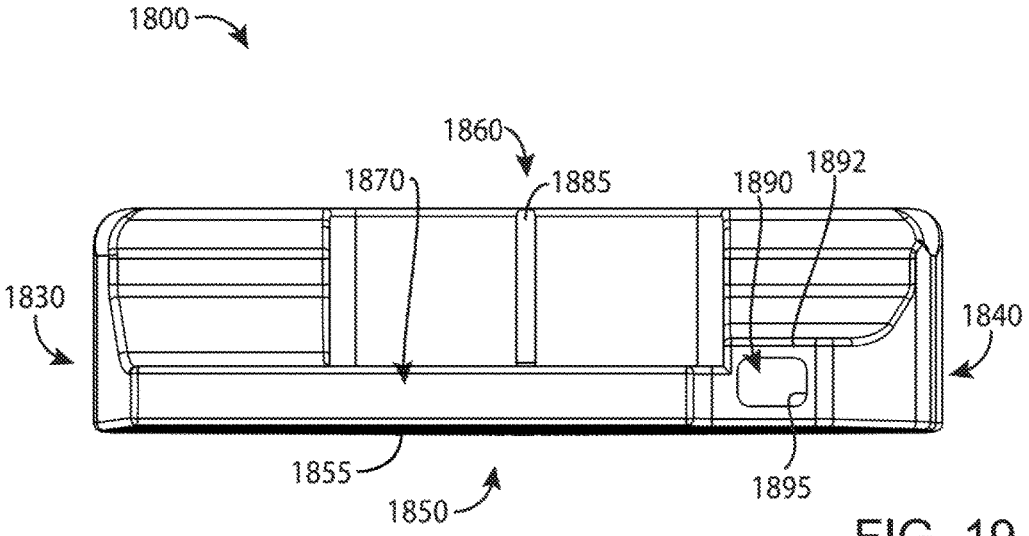
FIG. 19 depicts a top view of the example golf club head of FIG. 18.
Figure 20:
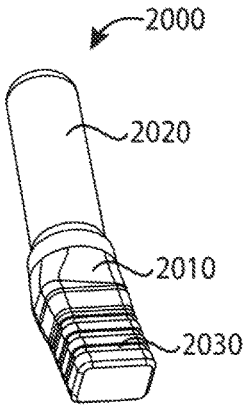
FIG. 20 depicts a front perspective view of a hosel portion according to an example of the apparatus, methods and articles of manufacture described herein.
Figure 21:
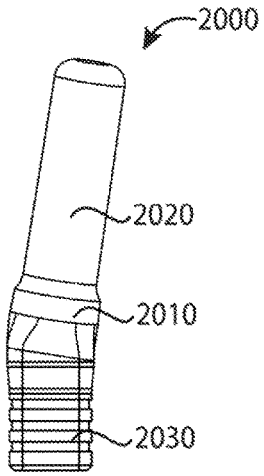
FIG. 21 depicts a front view of the hosel portion of FIG. 20.
Figure 22:
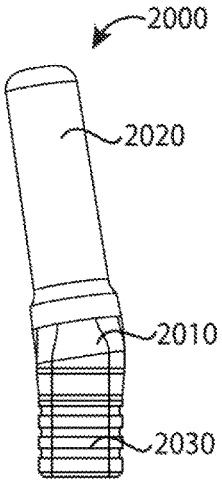
FIG. 22 depicts a rear view of the hosel portion of FIG. 20.
Figure 23:
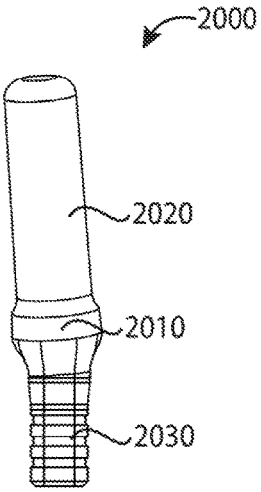
FIG. 23 depicts a left view of the hosel portion of FIG. 20.
Figure 24:
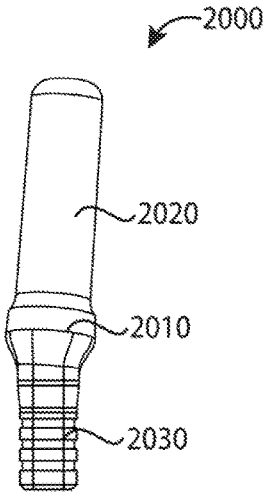
FIG. 24 depicts a right view of the hosel portion of FIG. 20.

In the example of FIGS. 18 and 19, a golf club head 1800 may include a body portion 1810 having a toe portion 1830, a heel portion 1840, a front portion 1850 with a face portion 1855 (e.g., similar to face portion 900), a rear portion 1860, a top portion 1870, a sole portion (not shown), one or more visual guides (e.g., shown as visual guide 1885), and one or more sets of weight ports (not shown) and corresponding sets of weight portions (not shown) as described herein. The body portion 1810 may be made from any of the materials described herein with respect to the body portion 210 in the example of FIGS. 2-8. The apparatus, methods, and articles of manufacture described herein are not limited in this regard.

The body portion 1810 may also include a cavity 1890 configured to receive a hosel portion (not shown in FIGS. 18 and 19). The cavity 1890 may be located at the top portion 1870. In one example, the cavity 1890 may be located at a recessed area 1892 of the top portion 1870 proximate the front portion 1850 and the heel portion 1840. The cavity 1890 may have an opening 1895 with a rounded rectangular shape. Alternatively, the opening 1895 of the cavity 1890 may have a different shape such as, but not limited to, circular, square, rounded square, triangular, rounded triangular, oval, rectangular, or any other shape that is suitable for receiving a hosel portion therein. The apparatus, methods, and articles of manufacture described herein are not limited in this regard.

Figure 25:
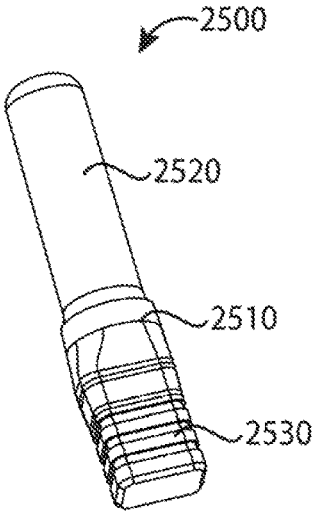
FIG. 25 depicts a front perspective view of a hosel portion according to an example of the apparatus, methods and articles of manufacture described herein.
Figure 26:
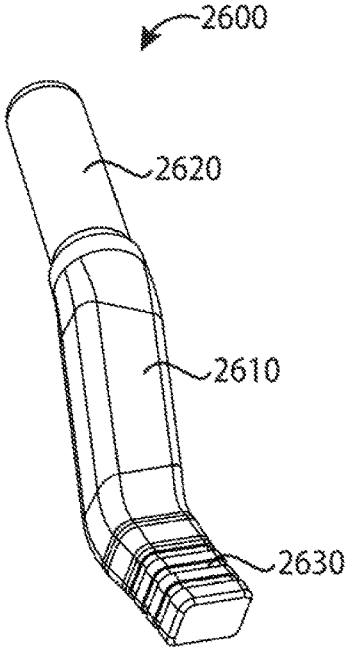
FIG. 26 depicts a front perspective view of a hosel portion according to an example of the apparatus, methods and articles of manufacture described herein.
Figure 27:
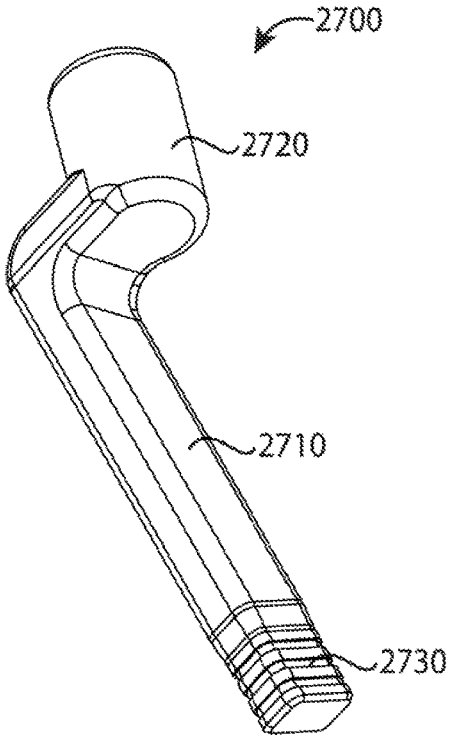
FIG. 27 depicts a front perspective view of a hosel portion according to an example of the apparatus, methods and articles of manufacture described herein.
Figure 28:
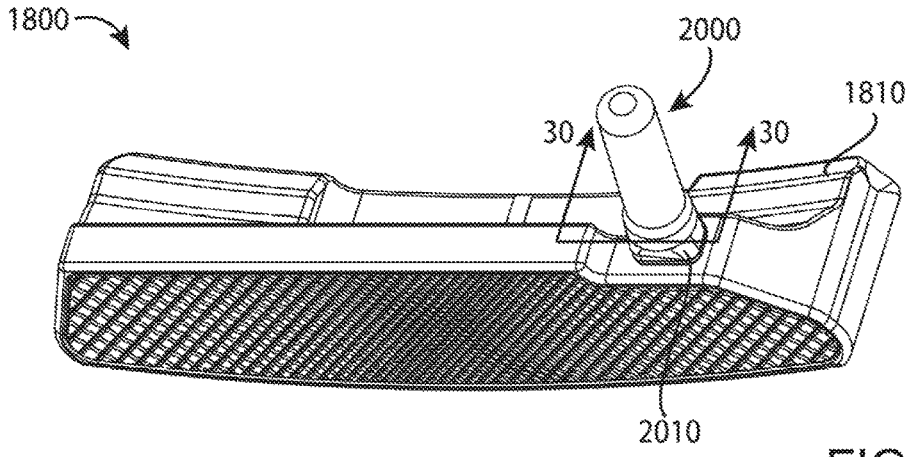
FIG. 28 depicts a front perspective view of the example golf club head of FIG. 18 including the hosel portion depicted in FIG. 20.
Figure 29:
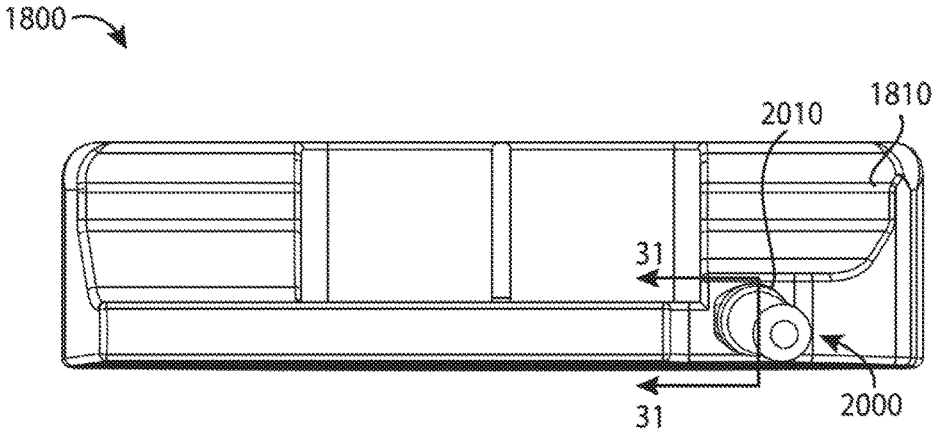
FIG. 29 depicts a top view of the example golf club head of FIG. 28.

In FIGS. 20-27, hosel portions having different neck configurations are shown for exemplary purposes. In the example of FIGS. 20-24, a hosel portion 2000 is shown including a neck portion 2010 having a double bend configuration. In the example of FIG. 25, a hosel portion 2500 is shown including a neck portion 2510 having a single bend configuration. In the example of FIG. 26, a hosel portion 2600 is shown including a neck portion 2610 having a slanted configuration. In the example of FIG. 27, a hosel portion 2700 is shown including a neck portion 2710 having a plumber's neck configuration. In the examples of FIGS. 20-26, the neck portions 2010, 2510, and 2610 may include corresponding stem portions 2020, 2520, and 2620. In the example of FIG. 27, the neck portion 2710 may include a bore portion 2720. The stem portions 2020, 2520, and 2620 and the bore portion 2720 are each capable of receiving a shaft (not shown). The hosel portions 2000, 2500, 2600, and 2700 may also include corresponding insert portions 2030, 2530, 2630, and 2730 that are each capable of being received in the cavity 1890 of the body portion 1810 shown in FIGS. 18 and 19. The insert portions 2030, 2530, 2630, and 2730 may be similarly configured to complement the shape of the cavity 1890. For example, the insert portions 2030, 2530, 2630, and 2730 may have a cross-section with a rounded rectangular shape. In other examples, the insert portions 2030, 2530, 2630, and 2730 may have other cross-sectional shapes based on the particular shape of the cavity 1890. The apparatus, methods, and articles of manufacture described herein are not limited in this regard.

The hosel portions 2000, 2500, 2600, and 2700 may be partially or entirely made of a steel-based material, a titanium-based material, an aluminum-based material (e.g., a high-strength aluminum alloy or a composite aluminum alloy coated with a high-strength alloy), a tungsten-based material, any combination thereof, and/or other suitable types of materials. Alternatively, the hosel portions 2000, 2500, 2600, and 2700 may be partially or entirely made of a non-metal material (e.g., composite, plastic, etc.). In one example, the hosel portions 2000, 2500, 2600, and 2700 may be entirely made of a steel-based material (e.g., 303 stainless steel) with a Rockwell hardness of 70-90 HRB. In another example, the hosel portions 2000, 2500, 2600, and 2700 may be entirely made of an aluminum-based material with a Rockwell hardness of 50-70 HRB. In one example, the hosel portions 2000, 2500, 2600, and 2700 may be made from the same material or a different material as the body portion 1810 of the golf club head 1800 shown in FIGS. 18 and 19. The apparatus, methods, and articles of manufacture described herein are not limited in this regard.

Figure 30:
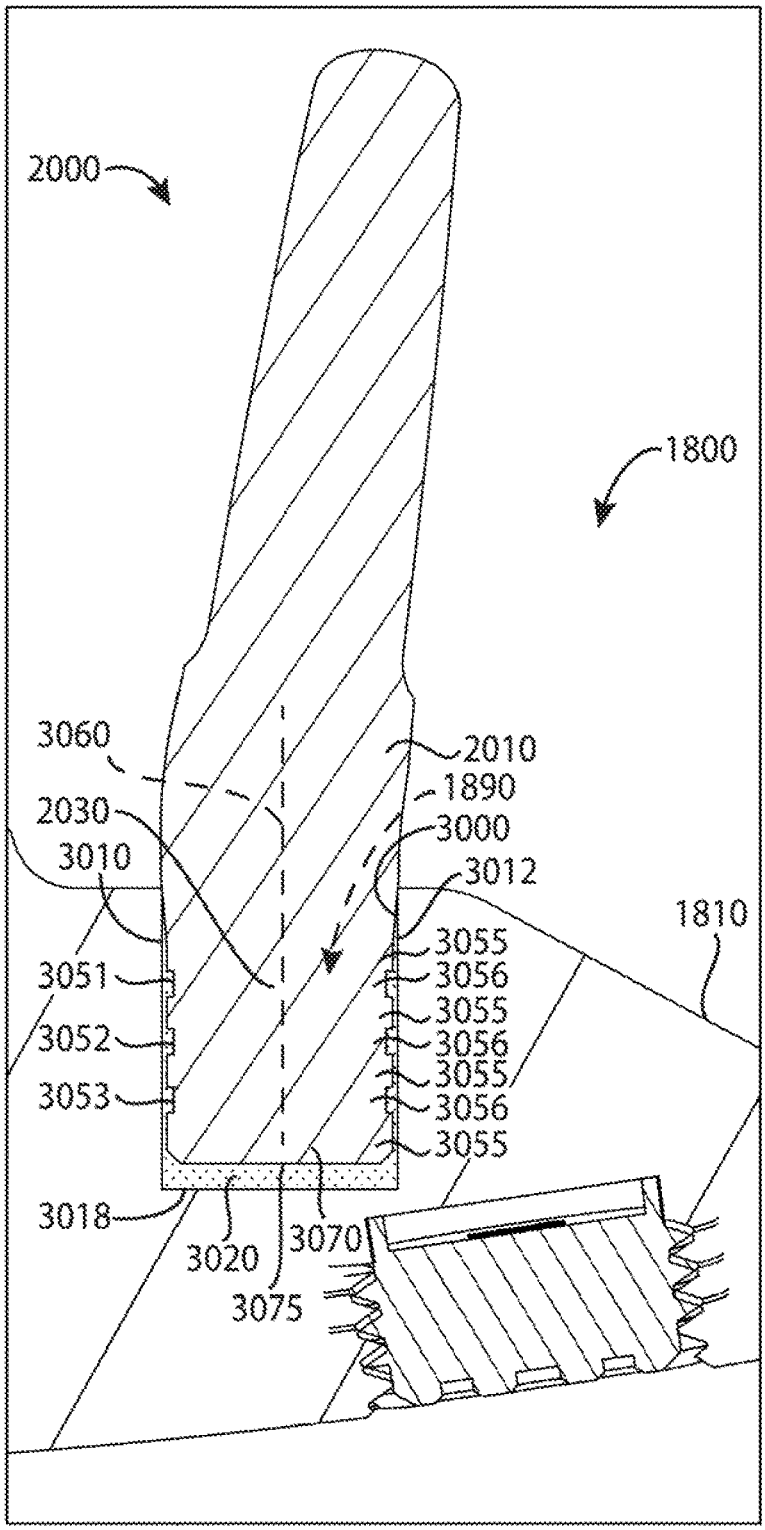
FIG. 30 depicts a cross-sectional view of the example golf club head of FIG. 28 taken at lines 30-30 of FIG. 28.
Figure 31:
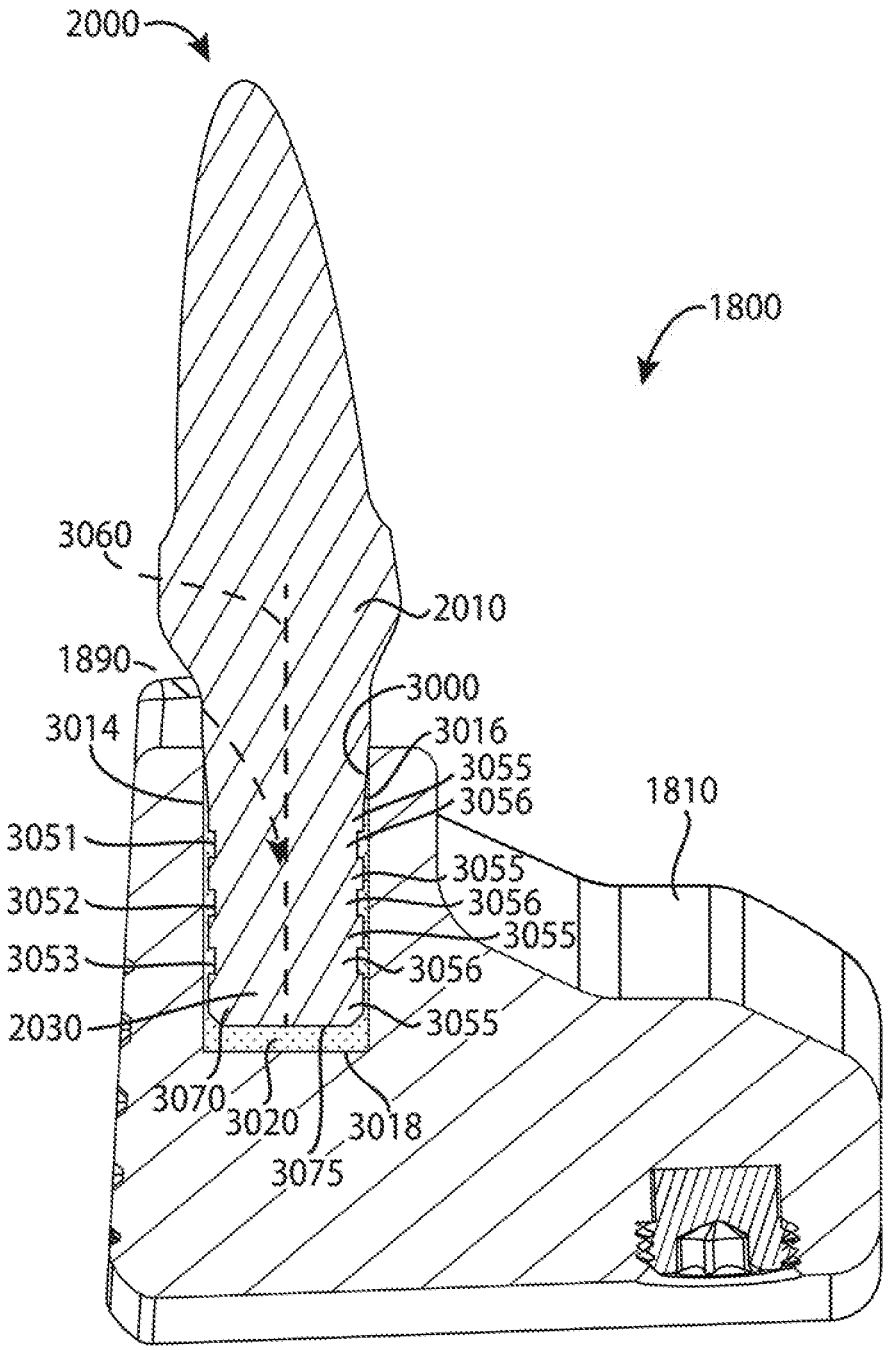
FIG. 31 depicts a cross-sectional view of the example golf club head of FIG. 28 taken at lines 31-31 of FIG. 29.

In the example of FIGS. 28-31, the golf club head 1800 of FIGS. 18 and 19 is shown with the hosel portion 2000 of FIGS. 20-24 assembled to the body portion 1810. Alternatively, any one of the other hosel portions 2500, 2600, and 2700 shown in FIGS. 25-27 may be similarly assembled to the body portion 1810 in the place of the hosel portion 2000. During assembly, the insert portion 2030 of the hosel portion 2000 is received inside the cavity 1890 of the body portion 1810. The hosel portion 2000 may be engaged to the body portion 1810 through an interference fit established with the cavity 1890 to ensure proper positioning (i.e., centering the insert portion 2030 of the hosel portion 2000 in the cavity 1890) of the hosel portion 2000 and to provide a seamless aesthetic between the hosel portion 2000 and the body portion 1810. In the example of FIGS. 30 and 31, the neck portion 2010 of the hosel portion 2000 may include a transition portion 3000 that diminishes in thickness or tapers toward the insert portion 2030. The transition portion 3000 may frictionally engage one or more side walls (e.g., shown as side walls 3010, 3012, 3014, and 3016) of the cavity 1890 at or proximate the opening 1895 to provide an interference fit between the transition portion 3000 and the side walls of the cavity 1890. The insert portion 2030 of the hosel portion 2000 may be spaced apart from the interior structure of the cavity 1890. Accordingly, the insert portion 2030 may be spaced from the side walls 3010, 3012, 3014, and 3016 and a base 3018 from which they extend. In one example, the insert portion 2030 may be closer to the side walls 3010, 3012, 3014, and 3016 than to the base 3018. The resulting space inside the cavity 1890 surrounding the insert portion 2030 may be partially or entirely filled with an epoxy 3020 or other adhesive to hold the insert portion 2030 in place, thereby securing the hosel portion 2000 to the body portion 1810. Accordingly, the hosel portion 2000 may be secured to the body portion 1810 without the need of any mechanical fasteners such as screws and the like. The apparatus, methods, and articles of manufacture described herein are not limited in this regard.

The insert portion 2030 may include one or more channels (e.g., shown as channels 3051, 3052, and 3053) encircling the insert portion 2030. The channels 3051, 3052, and 3053 may be parallel or substantially parallel to each other. The channels 3051, 3052, and 3053 may be concentric about a longitudinal axis 3060 of the insert portion 2030. The channels 3051, 3052, and 3053 may engage with the epoxy 3020 inside the cavity 1890 and serve as a mechanical locking mechanism between the insert portion 2030 and the epoxy 3020. The channels 3051, 3052, and 3053 may include a square-shaped cross section or other cross section (e.g., U-shaped, V-shaped, T-shaped, triangle-shaped, saw-tooth-shaped). A cross section of the channels 3051, 3052, and 3053 may be symmetrical or asymmetrical. The channels 3051, 3052, and 3053 may be evenly or unevenly spaced apart in a longitudinal direction along the insert portion 2030. The channels 3051, 3052, and 3053 may be located on the insert portion 2030 such that the insert portion 2030 alternates between two or more portions with differing perimeter sizes, thereby providing the insert portion 2030 with greater surface area with which to engage the epoxy 3020. For example, the channels 3051, 3052, and 3053 may be located on the insert portion 2030 such that the insert portion 2030 alternates between a first portion 3055 and a second portion 3056. The first portion 3055 may have a larger perimeter than the second portion 3056 or vice versa. In one example, the channels 3051, 3052, and 3053 may have a depth of approximately 0.010 inch and a width of approximately 0.040 inch. In alternative examples, the channels 3051, 3052, and 3053 may have different depths and/or widths. The apparatus, methods, and articles of manufacture described herein are not limited in this regard.

In one example, the cavity 1890 may have a length of approximately 0.372 inch, a width of approximately 0.260 inch, and a depth of approximately 0.470 inch. In one example, a first spacing between the transition portion 3000 of the neck portion 2010 and each of the side walls 3010, 3012, 3014, and 3016 may gradually increase up to approximately 0.010 inch in a direction toward the base 3018. A second spacing between the first portion(s) 3055 of the insert portion 2030 and each of the side walls 3010, 3012, 3014, and 3016 may be approximately 0.010 inch. A third spacing between the second portion(s) 3056 of the insert portion 2030 and each of the side walls 3010, 3012, 3014, and 3016 may be approximately 0.020 inch. A fourth spacing between a lower portion 3070 of the insert portion 2030 and each of the side walls 3010, 3012, 3014, and 3016 may gradually increase from approximately 0.010 inch to approximately 0.030 inch in a direction toward the base 3018. A fifth spacing between a terminal end 3075 of the lower portion 3070 and the base 3018 may be approximately 0.040 inch. The transition portion 3000 of the neck portion 2010 may be tapered at a first angle to define the gradual increase in the first spacing in a direction toward the base 3018. The lower portion 3070 may be tapered at a second angle to define the gradual increase in the fourth spacing in a direction toward the base 3018. The first angle may be greater than, equal to, or less than the second angle. In one example, the transition portion 3000 may be tapered at approximately five degrees relative to longitudinal axis 3060, and the lower portion 3070 may be tapered at approximately forty-five degrees relative to the longitudinal axis 3060. Accordingly, the spacing between the insert portion 2030 and the base 3018 may be generally greater than the spacing between the insert portion 2030 and any of the side walls 3010, 3012, 3014, and 3016. The apparatus, methods, and articles of manufacture described herein are not limited in this regard.

Figure 32:
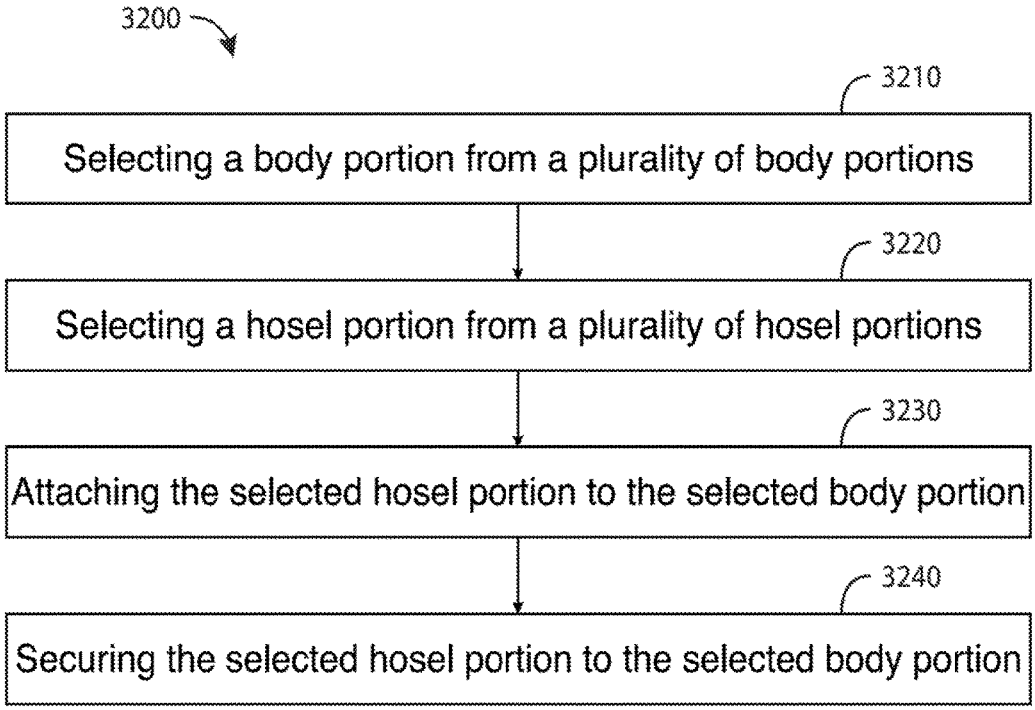
FIG. 32 depicts a method of assembling a golf club head according to an example of the apparatus, methods and articles of manufacture described herein.

In the example of FIG. 32, a method 3200 of assembling a golf club head is generally shown by blocks 3210-3240. At block 3210, a body portion is provided and may be selected from a plurality of body portions. Each of the plurality of body portions may be a putter-type body having a cavity similar to the cavity 1890 shown in FIGS. 18 and 19. The plurality of body portions may include one or more blade-type putter bodies, one or more mid-mallet-type putter bodies, one or more mallet-type putter bodies, and/or any other putter-type bodies. At block 3220, a hosel portion is provided and may be selected from a plurality of hosel portions. The plurality of hosel portions may include any one of the hosel portions 2000, 2500, 2600, and 2700 of FIGS. 20-27, respectively, and/or any other hosel portion types. Each of the plurality of hosel portions may include either a stem or a bore portion, a neck portion, and an insert portion capable of being received in the cavity of any one of the plurality of body portions. At block 3230, the selected hosel portion may be attached to the selected body portion. The selected hosel portion may be attached to the selected body portion by press-fitting the selected hosel portion into the cavity of the selected body portion such that the insert portion of the selected hosel portion is received inside the cavity and an interference fit is established between the neck portion of the selected hosel portion and the cavity of the selected body portion. At block 3240, the selected hosel portion may be secured to the selected body portion. The selected hosel portion may be secured to the selected body portion using an epoxy or other adhesive to hold the insert portion of the selected hosel portion in place inside the cavity of the selected body portion. The cavity of the selected body portion may be partially filled with the epoxy or other adhesive prior to attaching the selected hosel portion to the selected body portion at block 3230. Additionally, or alternatively, the epoxy or other adhesive may be applied to the insert portion of the selected hosel portion prior to attaching the selected hosel portion to the selected body portion at block 3230. Accordingly, the method 3200 outlined above may provide a variety of combinations between the plurality of body portions and the plurality of hosel portions. As such, a golf club head may be assembled by selecting a body portion and a hosel portion that are optimized to a particular player's putting stroke. The apparatus, methods, and articles of manufacture described herein are not limited in this regard.

Figure 33:
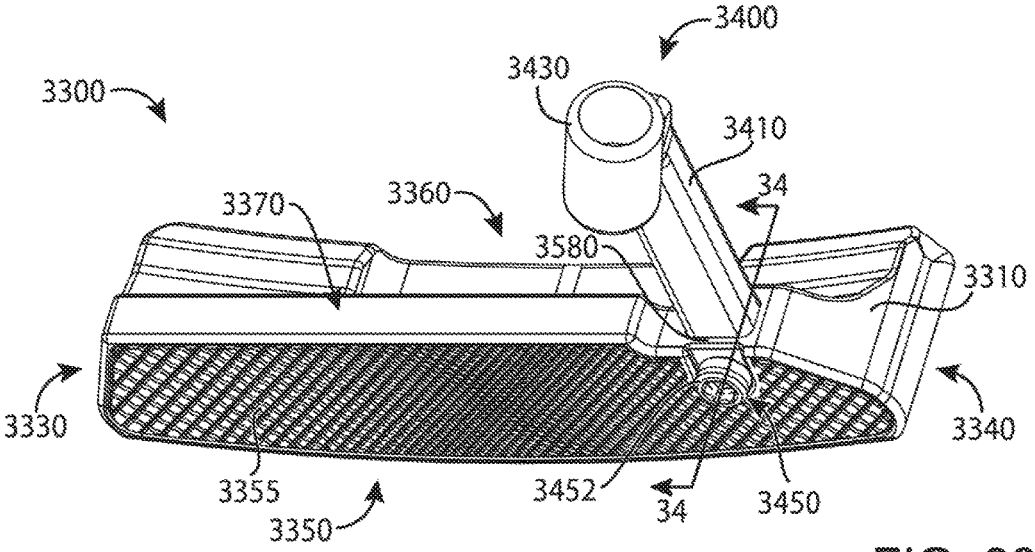
FIG. 33 depicts front perspective view of a golf club head according to an example of the apparatus, methods, and articles of manufacture described herein.
Figure 34:
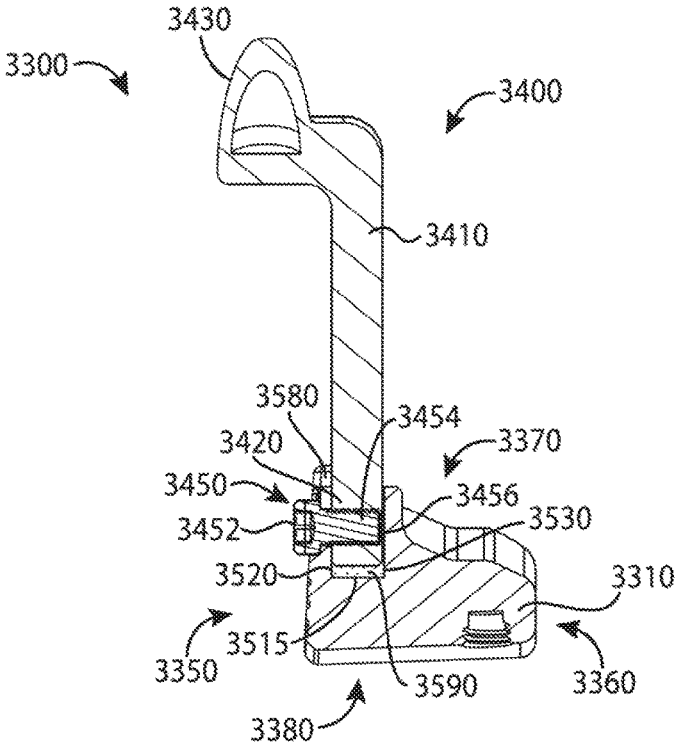
FIG. 34 depicts a cross-sectional view of the example golf club head of FIG. 33 taken at lines 34-34 of FIG. 33.
Figure 35:
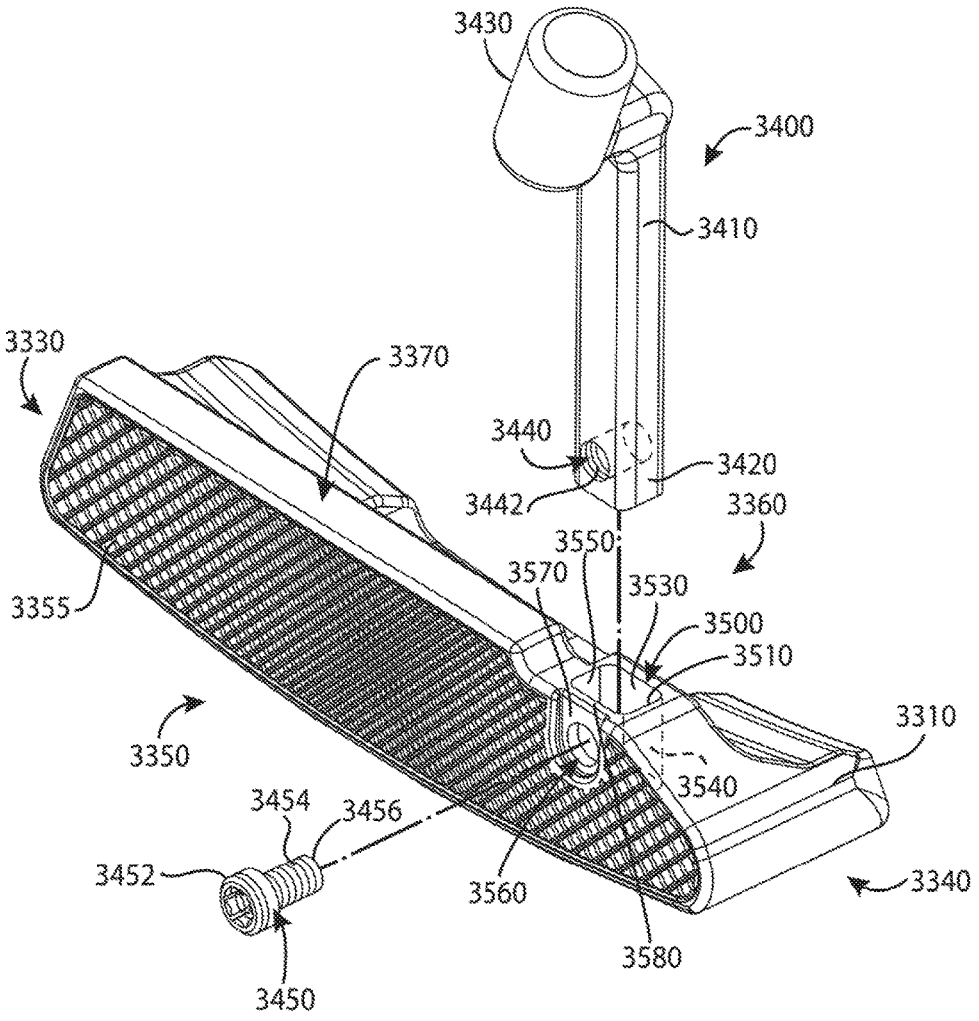
FIG. 35 depicts an exploded view of the example golf club head of FIG. 33.

In the example of FIGS. 33-35, a golf club head 3300 may include a body portion 3310 having a toe portion 3330, a heel portion 3340, a front portion 3350 with a face portion 3355, a rear portion 3360, a top portion 3370, and a sole portion 3380. The body portion 3310 may be made from any of the materials described herein. The face portion 3355 may be similar in many or all respects to the face portion 900 shown in FIGS. 9 and 10. The face portion 3355 may be an integral portion of the body portion 3310. Alternatively, the face portion 3355 may be a separate piece or an insert coupled to the body portion 3310 via various manufacturing and/or processes (e.g., a bonding process, a welding process, a brazing process, a mechanical locking method, a mechanical fastening method, any combination thereof, or other suitable types of manufacturing methods and/or processes). The face portion 3355 may be associated with a loft plane that defines the loft angle of the golf club head 3300. The apparatus, methods, and articles of manufacture described herein are not limited in this regard.

The body portion 3310 may also include a cavity 3500 configured to receive a hosel portion 3400. The cavity 3500 may be located at the top portion 3370 and may extend downward into the body portion 3310. The cavity 3500 may be similar to the cavity 1890 shown in FIGS. 18 and 19. For example, the cavity 3500 may have an opening 3510, a base 3515, and one or more side walls (e.g., shown as side walls 3520, 3530, 3540, and 3550) extending therebetween. The base 3515 and the side walls 3520, 3530, 3540, and 3550 may define an interior structure of the cavity 3500. The opening 3510 may have a rounded rectangular shape or other desired shape. The apparatus, methods, and articles of manufacture described herein are not limited in this regard.

A through-hole 3560 may be located at the front portion 3350 and feeds into the cavity 3500 through a side wall (e.g., side wall 3520) of the cavity 3500. The side wall 3520 may be located behind the face portion 3355 and at least a portion of the side wall 3520 may generally face rearward of the body portion 3310. The through-hole 3560 may be cylindrical in shape and may extend from the front portion 3350 in a direction rearward of the body portion 3310. The through-hole 3560 may be located in a recessed portion 3570 of the front portion 3350 adjacent the opening 3510 of the cavity 3500. The recessed portion 3570 may be U-shaped and may delimit an upper extent of the face portion 3355. The apparatus, methods, and articles of manufacture described herein are not limited in this regard.

The hosel portion 3400 may include a neck portion 3410 extending from an insert portion 3420. The hosel portion 3400 may be made from any of the materials described herein. Accordingly, the hosel portion 3400 may be made from the same or different material as the body portion 3310. For the purpose of illustration, the hosel portion 3400 is exemplarily shown having a plumber's neck configuration and may include a bore portion 3430 capable of receiving a shaft (not shown). In alternative examples, the hosel portion 3400 may have a different neck configuration such as, but not limited to, a double bend configuration, a single bend configuration, or a slanted configuration, as described herein. In the illustrated example, the insert portion 3420 may have a cross-sectional shape that is complementary to the cavity 3500 and promotes a clearance or frictional fit therebetween. The insert portion 3420 may include a fastener port 3440 and is received inside the cavity 3500 such that the fastener port 3440 interfaces with the through-hole 3560. In this way, a complementary fastener, shown as fastener 3450 may be received in the through-hole 3560 and engaged to the fastener port 3440, thereby securing the hosel portion 3400 to the body portion 3310. The apparatus, methods, and articles of manufacture described herein are not limited in this regard.

In one example, the fastener 3450 may be a bolt or a screw. The fastener 3450 may include a head 3452 and external threads 3454 for engaging complementary internal threads 3442 of the fastener port 3440. The fastener port 3440 may be configured as a through-hole and the fastener 3450 may be sized such that a tip portion 3456 of the fastener 3450 abuts against side wall 3530 when the fastener 3450 is fully fastened to the fastener port 3440, thereby resulting in a continuous physical force being exerted by the fastener 3450 against the side wall 3530 for holding the hosel portion 3400 in place. Alternatively, the tip portion 3456 may stop short of the side wall 3530 when the fastener 3450 is fully fastened to the fastener port 3440. Tightening of the fastener 3450 may pull the hosel portion 3400 forward toward the front portion 3350, thereby resulting in a continuous physical force being exerted by the hosel portion 3400 against side wall 3520 of the cavity 3500. In other words, tightening of the fastener 3450 may result in a clamping pressure exerted by the hosel portion 3400 and the fastener 3450 against an intervening structure 3580 of the body portion 3310 that separates the recessed portion 3570 and the cavity 3500. The amount of tightening of the fastener 3450 may be limited by the head 3452 pressing or abutting against the recessed portion 3570 of the front portion 3350. The depth of the recessed portion 3570 may be determined based on a desired side profile of the head 3452. In other words, increasing the depth of the recessed portion 3570 may reduce the amount in which the head 3452 protrudes forward from the front portion 3350. In some examples, the depth of the recessed portion 3570 is such that the head 3452 is at least flush (i.e., no visible side profile) with the face portion 3355. In other examples, the depth of the recessed portion 3570 is such that head 3452 partially or entirely protrudes forward from the front portion 3350. In examples where the head 3452 protrudes forward of the front portion 3350, the golf club head 3300 may be deemed non-conforming by the rules of golf but would nevertheless find use in fitting/testing scenarios and in the hands of recreational golfers. Based on the application, the fastener 3450 may or may not be readily removable with a tool. The apparatus, methods, and articles of manufacture described herein are not limited in this regard.

The insert portion 3420 of the hosel portion 3400 may be spaced apart from the base 3515 of the cavity 3500 when secured to the body portion 3310 using the fastener 3450. An intermediate material 3590 may be provided inside the cavity 3500 between the base 3515 and the insert portion 3420 of the hosel portion 3400. The intermediate material 3590 may be configured to dampen vibration and prevent deeper travel of the insert portion 3420 inside the cavity 3500. In one example, the height of the intermediate material 3590 may be such that when the insert portion 3420 comes to rest against the intermediate material 3590, the fastener port 3440 is auto-aligned with the through-hole 3560. The intermediate material 3590 may include a compressible foam, elastomer, or other material with vibration dampening behavior. In alternative examples, the intermediate material 3590 may be omitted in favor of extending the length of the insert portion 3420 or reducing the depth of the cavity 3500 to promote contact between the insert portion 3420 and the base 3515 of the cavity 3500. The apparatus, methods, and articles of manufacture described herein are not limited in this regard.

Figure 36:
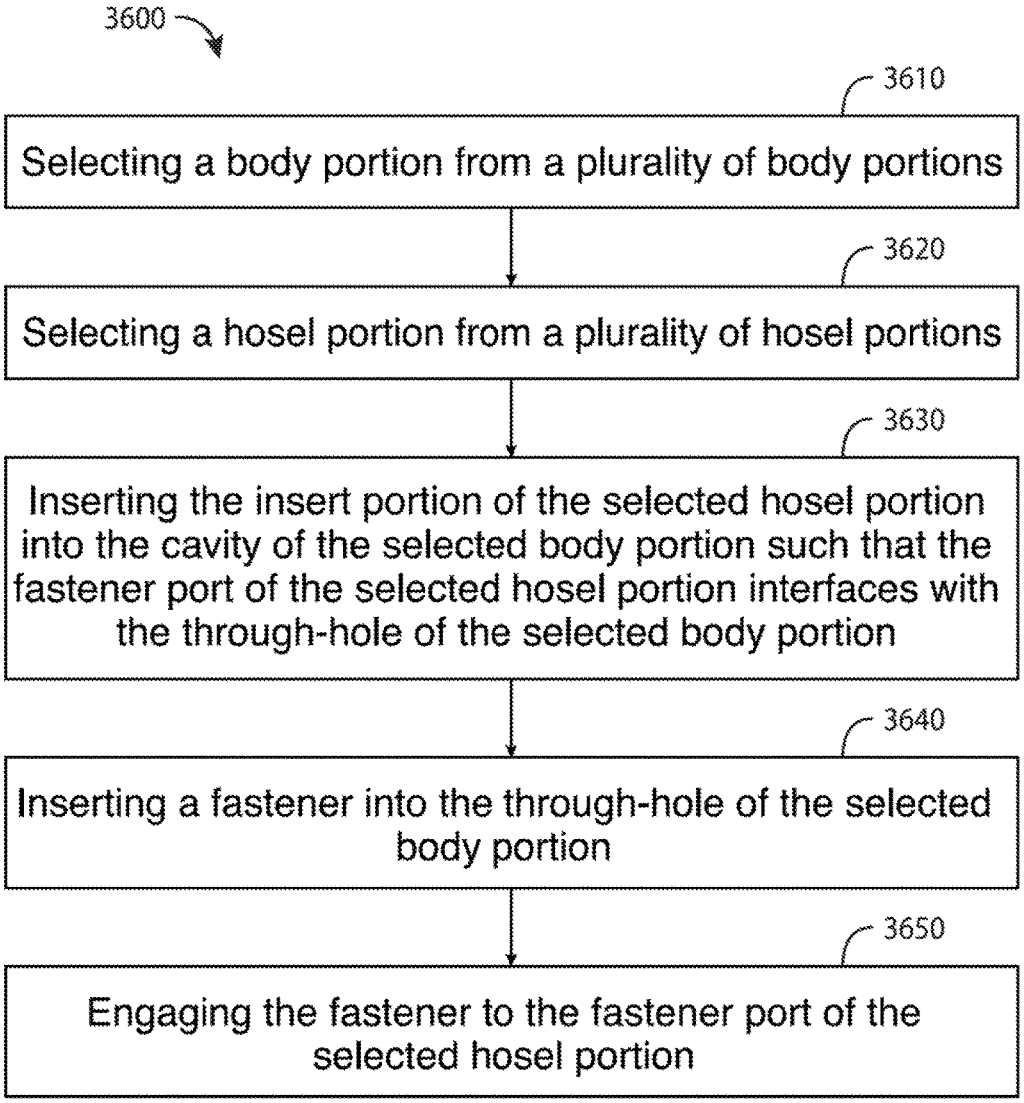
FIG. 36 depicts a method of assembling a golf club head according to an example of the apparatus, methods and articles of manufacture described herein.

In the example of FIG. 36, a method 3600 of assembling a golf club head is generally shown by blocks 3610-3650. At block 3610, a body portion may be selected from a plurality of body portions. Each of the plurality of body portions may be a putter-type body having a cavity extending downward into the body portion and a through-hole located at the front portion and feeding into the cavity. For example, each of the plurality of body portions may have a cavity and through-hole similar to the cavity 3500 and through-hole 3560 shown in FIG. 35. The plurality of body portions may include one or more blade-type putter bodies, one or more mid-mallet-type putter bodies, one or more mallet-type putter bodies, and/or any other putter-type bodies. The apparatus, methods, and articles of manufacture described herein are not limited in this regard.

At block 3620, a hosel portion is provided and may be selected from a plurality of hosel portions. The plurality of hosel portions may include one or more hosel portions with a double bend neck configuration, one or more hosel portions with a single bend neck configuration, one or more hosel portions with a plumber's neck configuration, one or more hosel portions with a slanted configuration, and/or one or more hosel portions of any other neck type. Each of the plurality of hosel portions may include an insert portion with a fastener port. The insert portion of each of the plurality of hosel portions may be similar to the insert portion 3420 shown in FIGS. 34 and 35. Accordingly, the insert portion of each of the plurality of hosel portions may be capable of being received in the cavity of any one of the plurality of body portions. In this way, the plurality of body portions and the plurality of hosel portions may be interchangeable with one another. The apparatus, methods, and articles of manufacture described herein are not limited in this regard.

At block 3630, the insert portion of the selected hosel portion may be inserted into the cavity of the selected body portion such that the fastener port of the selected hosel portion interfaces with the through-hole of the selected body portion. In some examples, an intermediate material may be provided inside the cavity of the selected body portion to dampen vibration and limit the insert portion of the selected hosel portion from traveling any deeper inside the cavity of the selected body portion. The intermediate material may also encourage alignment between the fastener port of the selected hosel portion and the through-hole of the selected body portion. The apparatus, methods, and articles of manufacture described herein are not limited in this regard.

At blocks 3640 and 3650, a fastener may be inserted into the through-hole of the selected body portion and the fastener may be engaged to the fastener port of the selected hosel portion, thereby securing the selected hosel portion to the selected body portion. As described herein, the fastener may be a bolt or screw having a tip portion that may abut and exert a continuous physical force against a side wall of the cavity for holding the hosel portion in place. Tightening of the fastener may pull the insert portion of the selected hosel portion forward against the cavity of the selected body portion, which may result in a continuous physical force being exerted by the hosel portion against a side wall of the cavity that generally faces rearward of the selected body portion. The amount in which the fastener is tightened may be limited by a head of the fastener pressing or abutting against the front portion of the selected body portion. In some examples, the front portion of the selected body portion may include a recessed portion that delimits an upper extent of the face portion and is where the through-hole is located. In these examples, the head of the fastener may press against the recessed portion to limit further tightening of the fastener. The depth of the recessed portion may be determined based on a desired amount of side profile for the fastener. In some examples, the fastener may be readily removable using a tool to allow quick disassembly of the golf club head. The same fastener may again be used in the assembly of any subsequent body portion and hosel portion combinations. The apparatus, methods, and articles of manufacture described herein are not limited in this regard.

Accordingly, the method 3600 outlined above may provide a variety of combinations between the plurality of body portions and the plurality of hosel portions. The method 3600 may be particularly useful in player fittings, whereby a fitter or tester can quickly assemble and disassemble as many combinations as is necessary to discover a body portion and hosel portion combination that is optimized to a particular player's putting stroke. Upon determining an optimal set up, the particular player's golf club head may be assembled pursuant to the method 3200 outlined in FIG. 32, for example. The apparatus, methods, and articles of manufacture described herein are not limited in this regard.

The apparatus, methods, and articles of manufacture described herein may include one or more club identifiers (e.g., a serial number, a matrix barcode, a brand name, a model, a club number, a loft angle, a character, etc.). For example, any of the golf club heads described herein may include a visual indicator such as a club number to identify the type of golf club. In one example, the club number may correspond to the loft angle of the golf club head (e.g., 3, 4, 5, 6, 7, 8, or 9). In one example, a 7-iron type golf club head may be marked with "7". In another example, a 54-degree wedge type golf club head may be marked "54". In yet another example, a 10.5-degree driver type golf club head may be marked "10.5." Any marking(s) associated with a club identifier may be visually differentiated (e.g., different color, texture, pattern, etc.) from the rest of the golf club head. The club identifier may be a trademark to identify a brand or a model of the golf club head. The club identifier may be another type of visual indicator such as a product number or a serial number to identify the golf club head as authentic equipment, to track inventory, or to distinguish the golf club head from fake or counterfeit products. Alternatively, the club identifier may be a digital signature or a machine-readable optical representation of information or data about the golf club head (e.g., numeric character(s), alphanumeric character(s), byte(s), a one-dimensional barcode such as a Universal Product Code (UPC), a two-dimensional barcode such as a Quick Response (QR) code, etc.). The club identifier may be placed at various locations on the golf club head (e.g., the hosel portion the face portion the sole portion etc.) using various methods (e.g., laser etched, stamped, casted, or molded onto the golf club head). For example, the club identifier may be a serial number laser etched onto the hosel portion of the golf club head. Instead of being an integral part of the golf club head, the club identifier may be a separate component coupled to the golf club head (e.g., a label adhered via an adhesive or an epoxy).

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising: a body portion including a cavity having an opening and an internal structure defined by a wall portion and a base portion; and an integrally formed hosel portion including: an insert portion; and a neck portion extending from the insert portion and configured to receive a shaft, wherein the hosel portion is attached to the body portion by an interference fit between the neck portion and the opening of the cavity, wherein the insert portion is received inside the cavity and is spaced apart from the internal structure of the cavity to define a space between the insert portion and the internal structure of the cavity, and wherein the space is partially or entirely filled with an adhesive to hold the hosel portion in place.

2. A golf club head as defined in claim 1, wherein the opening of the cavity has a rounded rectangular shape.

3. A golf club head as defined in claim 1, wherein the insert portion is configured to alternate between two or more portions with differing perimeter sizes.

4. A golf club head as defined in claim 1, wherein the insert portion includes one or more channels configured to engage with the adhesive inside the cavity and serve as a mechanical locking mechanism between the insert portion and the adhesive.

5. A golf club head as defined in claim 1, wherein the insert portion includes two or more channels encircling the insert portion, the two or more channels arranged in parallel with each other and concentric with a longitudinal axis of the insert portion.

6. A golf club head as defined in claim 1, wherein the insert portion is closer to the wall portion than to the base portion.

7. A golf club head as defined in claim 1, wherein the body portion is made from a first material and the hosel portion is made from a second material different from the first material.

8. A golf club head comprising: a body portion including a cavity having an opening and an internal structure defined by a wall portion and a base portion; an integrally formed hosel portion, formed separately from the body portion, the hosel portion including: an insert portion having one or more channels encircling the insert portion; and a neck portion configured to receive a shaft and having a transition portion that tapers toward the insert portion, wherein the hosel portion is attached to the body portion such that the transition portion frictionally engages the wall portion at or proximate the opening of the cavity and the insert portion is received inside the cavity, and is spaced apart from the internal structure of the cavity to define a space between the insert portion and the internal structure of the cavity; and an epoxy partially or entirely filling the space between the insert portion and the internal structure of the cavity, wherein the one or more channels of the insert portion engage the epoxy to serve as a mechanical locking mechanism between the insert portion and the epoxy.

9. A golf club head as defined in claim 8, wherein the cavity and the hosel portion include cross sections having a rounded rectangular shape.

10. A golf club head as defined in claim 8, wherein the one or more channels include at least three channels evenly spaced along a longitudinal axis of the insert portion.

11. A golf club head as defined in claim 8, wherein the one or more channels include at least three channels arranged in parallel and concentric about a longitudinal axis of the insert portion.

12. A golf club head as defined in claim 8, wherein the insert portion includes a lower portion that tapers toward a terminal end located closest to the base portion of the cavity.

13. A golf club head as defined in claim 8, wherein the body portion is made from one of a steel-based material and an aluminum-based material, and the hosel portion is made from a steel-based material.

14. A golf club head comprising: a body portion including a toe portion, a heel portion, a front portion with a face portion for impacting a golf ball, a rear portion, a top portion, a sole portion, a plurality of weight ports at the sole portion, and a cavity having an opening and an internal structure defined by a wall portion and a base portion; a plurality of weight portions with each weight portion of the plurality of weight portions disposed in one weight port of the plurality of weight ports; an integrally formed hosel portion, formed separately from the body portion, the hosel portion including: an insert portion configured to alternate between a first portion and a second portion along a longitudinal axis of the insert portion, the first portion having a perimeter size different from a perimeter size of the second portion, the alternating first and second portions defining a plurality of channels encircling the insert portion and increasing a surface area of the insert portion; and a neck portion configured to receive a shaft and having a transition portion that tapers toward the insert portion, wherein the hosel portion is attached to the body portion such that the transition portion frictionally engages the wall portion at or proximate the opening of the cavity and the insert portion is received inside the cavity, and is spaced apart from the internal structure of the cavity to define a space between the insert portion and the internal structure of the cavity; and an epoxy partially or entirely filling the space between the insert portion and the internal structure of the cavity, wherein the plurality of channels of the insert portion engage the epoxy to serve as a mechanical locking mechanism between the insert portion and the epoxy.

15. A golf club head as defined in claim 14, wherein the body portion is configured as a blade-type putter body.

16. A golf club head as defined in claim 14, wherein the plurality of weight ports includes a first set of weight ports and a second set of weight ports, wherein each weight port of the first set of weight ports is a different size than each weight port of the second set of weight ports, and wherein the first set of weight ports has a different number of weight ports than the second set of weight ports.

17. A golf club head as defined in claim 14, wherein the insert portion includes a lower portion that tapers to a terminal end, wherein the lower portion tapers at a first angle relative the longitudinal axis of the insert portion, wherein the transition portion tapers at a second angle relative the longitudinal axis of the insert portion, and wherein the first angle is different from the second angle.

18. A golf club head as defined in claim 14, wherein the face portion includes a plurality of projections arranged in an array within a perimeter of the face portion, wherein a smallest one of the plurality of projections is located at or proximate a geometric center of the face portion, and wherein the plurality of projections successively increase in size in any direction moving from the geometric center to the perimeter of the face portion.

19. A golf club head as defined in claim 14, wherein the plurality of channels each have a depth of approximately 0.010 inch and a width of approximately 0.040 inch.

20. A golf club head as defined in claim 14, wherein a first spacing between the transition portion of the neck portion and the wall portion gradually increases up to approximately 0.010 inch in a direction toward the base portion, wherein a second spacing between the first portion of the insert portion and the wall portion is approximately 0.010 inch, wherein a third spacing between the second portion of the insert portion and the wall portion is approximately 0.020 inch, wherein a fourth spacing between a lower portion of the insert portion and the wall portion gradually increases from approximately 0.010 inch to approximately 0.030 inch in a direction toward the base portion, and wherein a fifth spacing between a terminal end of the lower portion and the base portion is approximately 0.040 inch.

* * * * *